US008777773B2

(12) United States Patent
Burnett et al.

(10) Patent No.: US 8,777,773 B2
(45) Date of Patent: Jul. 15, 2014

(54) GOLF CLUB HEAD HAVING TRIP STEP FEATURE

(75) Inventors: Michael Scott Burnett, McKinney, TX (US); Marc Schmidt, Dallas, TX (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 13/584,479

(22) Filed: Aug. 13, 2012

(65) Prior Publication Data

US 2012/0316007 A1 Dec. 13, 2012

Related U.S. Application Data

(62) Division of application No. 12/361,290, filed on Jan. 28, 2009, now abandoned.

(60) Provisional application No. 61/080,892, filed on Jul. 15, 2008, provisional application No. 61/101,919, filed on Oct. 1, 2008.

(51) Int. Cl.
*A63B 53/00* (2006.01)

(52) U.S. Cl.
USPC ..... 473/327; 473/345

(58) Field of Classification Search
USPC ..... 473/327
IPC ..... A63B 53/00
See application file for complete search history.

(56) References Cited

U.S. PATENT DOCUMENTS 2,083,189 A 6/1937 Crooker
3,085,804 A 4/1963 Pieper
3,166,320 A 1/1965 Onions
3,266,805 A 8/1966 Bulla
3,468,544 A 9/1969 Antonious (Continued)

FOREIGN PATENT DOCUMENTS

EP 0446935 A1 9/1991
WO 2005009543 2/2005

OTHER PUBLICATIONS

International Searching Authority (USPTO), International Search Report and Written Opinion for International Application No. PCT/US 09/49742, mailed Aug. 27, 2009, 11 pages.

(Continued)

*Primary Examiner* — Gene Kim
*Assistant Examiner* — Matthew B Stanczak
(74) *Attorney, Agent, or Firm* — David J. Dawsey; Michael J. Gallagher; Gallagher & Dawsey Co., LPA

(57) ABSTRACT

A golf club incorporating a trip step feature located on the crown section. The benefits associated with the reduction in aerodynamic drag force associated with the trip step may be applied to drivers, fairway woods, and hybrids. A portion of the trip step is located between a crown apex and the back of the club head and may be continuous or discontinuous. The trip step enables a reduction in the aerodynamic drag force exerted on the golf club by forcing the air passing over the club head from laminar flow to turbulent flow prior to the natural separation point of the airstream from the crown. This selectively engineered transition from laminar to turbulent flow over the crown section slightly increases the skin friction but results in less aerodynamic drag than if the air were to detach from the crown section at the natural separation point.

19 Claims, 27 Drawing Sheets

(56) References Cited

U.S. PATENT DOCUMENTS

| | | | | |
|---|---|---|---|---|
| 3,893,672 | A | | 7/1975 | Schonher |
| 3,985,363 | A | | 10/1976 | Jepson et al. |
| 3,997,170 | A | | 12/1976 | Goldberg |
| 4,065,133 | A | | 12/1977 | Gordos |
| 4,077,633 | A | | 3/1978 | Studen |
| 4,139,196 | A | | 2/1979 | Riley |
| 4,147,349 | A | | 4/1979 | Jeghers |
| 4,165,076 | A | | 8/1979 | Cella |
| 4,193,601 | A | | 3/1980 | Reid, Jr. et al. |
| D256,709 | S | | 9/1980 | Reid, Jr. et al. |
| 4,247,105 | A | | 1/1981 | Jeghers |
| D265,112 | S | | 6/1982 | Lyons |
| 4,431,192 | A | | 2/1984 | Stuff, Jr. |
| 4,471,961 | A | | 9/1984 | Masghati et al. |
| 4,527,799 | A | | 7/1985 | Solheim |
| 4,592,552 | A | | 6/1986 | Garber |
| 4,754,974 | A | | 7/1988 | Kobayashi |
| 4,787,636 | A | | 11/1988 | Honma |
| 4,881,739 | A | | 11/1989 | Garcia |
| 4,895,367 | A | | 1/1990 | Kajita et al. |
| 4,919,428 | A | | 4/1990 | Perkins |
| 5,054,784 | A | | 10/1991 | Collins |
| 5,092,599 | A | | 3/1992 | Okumoto et al. |
| 5,116,054 | A | | 5/1992 | Johnson |
| 5,190,289 | A | | 3/1993 | Nagai et al. |
| 5,193,810 | A | | 3/1993 | Antonious |
| 5,221,086 | A | | 6/1993 | Antonious |
| 5,255,919 | A | | 10/1993 | Johnson |
| 5,301,944 | A | | 4/1994 | Koehler |
| 5,318,297 | A | | 6/1994 | Davis et al. |
| D349,543 | S | | 8/1994 | MacDougall |
| 5,340,106 | A | | 8/1994 | Ravaris |
| 5,435,558 | A | * | 7/1995 | Iriarte ..... 473/327 |
| 5,482,280 | A | | 1/1996 | Yamawaki |
| 5,511,786 | A | | 4/1996 | Antonious |
| 5,558,332 | A | | 9/1996 | Cook |
| D375,130 | S | | 10/1996 | Hlinka et al. |
| D378,770 | S | | 4/1997 | Hlinka et al. |
| 5,632,695 | A | | 5/1997 | Hlinka et al. |
| 5,695,412 | A | | 12/1997 | Cook |
| 5,700,208 | A | | 12/1997 | Nelms |
| 5,759,114 | A | | 6/1998 | Bluto et al. |
| 5,785,608 | A | | 7/1998 | Collins |
| D401,650 | S | | 11/1998 | Burrows |
| 5,876,293 | A | | 3/1999 | Musty |
| 5,885,166 | A | | 3/1999 | Shiraishi |
| 5,890,971 | A | | 4/1999 | Shiraishi |
| 5,935,020 | A | | 8/1999 | Stites et al. |
| 5,954,595 | A | | 9/1999 | Antonious |
| 6,001,029 | A | * | 12/1999 | Kobayashi ..... 473/327 |
| 6,033,319 | A | | 3/2000 | Farrar |
| 6,074,308 | A | | 6/2000 | Domas |
| 6,083,115 | A | | 7/2000 | King |
| 6,093,113 | A | | 7/2000 | Mertens |
| 6,123,627 | A | | 9/2000 | Antonious |
| 6,168,537 | B1 | | 1/2001 | Ezawa |
| 6,402,639 | B1 | | 6/2002 | Iwata et al. |
| 6,458,042 | B1 | | 10/2002 | Chen |
| 6,464,598 | B1 | | 10/2002 | Miller |
| 6,530,847 | B1 | | 3/2003 | Antonious |
| D482,420 | S | | 11/2003 | Burrows |
| 6,723,002 | B1 | | 4/2004 | Barlow |
| 6,773,359 | B1 | | 8/2004 | Lee |
| D501,903 | S | | 2/2005 | Tanaka |
| 6,855,068 | B2 | | 2/2005 | Antonious |
| D515,643 | S | | 2/2006 | Ortiz |
| 7,004,849 | B2 | | 2/2006 | Cameron |
| D522,601 | S | | 6/2006 | Schweigert |
| 7,163,470 | B2 | | 1/2007 | Galloway et al. |
| 7,166,038 | B2 | | 1/2007 | Williams et al. |
| 7,169,058 | B1 | | 1/2007 | Fagan |
| D537,495 | S | | 2/2007 | Schweigert |
| D543,600 | S | | 5/2007 | Oldknow |
| D544,939 | S | | 6/2007 | Radcliffe et al. |
| D549,792 | S | | 8/2007 | Parise |
| D552,198 | S | | 10/2007 | Schweigert |
| D554,720 | S | | 11/2007 | Barez et al. |
| 7,294,064 | B2 | | 11/2007 | Tsurumaki et al. |
| D564,611 | S | | 3/2008 | Llewellyn |
| 7,390,266 | B2 | | 6/2008 | Gwon |
| D589,103 | S | | 3/2009 | Kohno |
| D622,338 | S | | 8/2010 | Kohno |
| D622,795 | S | | 8/2010 | Furutate |
| 7,766,765 | B2 | | 8/2010 | Oyama |
| 8,083,609 | B2 | | 12/2011 | Burnett et al. |
| 8,088,021 | B2 | | 1/2012 | Albertsen et al. |
| 2002/0183130 | A1 | | 12/2002 | Pacinella |
| 2003/0220154 | A1 | | 11/2003 | Anelli |
| 2004/0192463 | A1 | | 9/2004 | Tsurumaki et al. |
| 2005/0009622 | A1 | * | 1/2005 | Antonious ..... 473/327 |
| 2006/0009305 | A1 | | 1/2006 | Lindsay |
| 2006/0094535 | A1 | | 5/2006 | Cameron |
| 2006/0258481 | A1 | | 11/2006 | Oyama |
| 2006/0281581 | A1 | | 12/2006 | Yamamoto |
| 2007/0105657 | A1 | | 5/2007 | Hirano |
| 2007/0275792 | A1 | | 11/2007 | Horacek et al. |
| 2008/0039234 | A1 | | 2/2008 | Williams et al. |
| 2008/0132356 | A1 | | 6/2008 | Chao et al. |
| 2010/0016095 | A1 | | 1/2010 | Burnett et al. |
| 2012/0071267 | A1 | | 3/2012 | Burnett et al. |
| 2012/0071268 | A1 | | 3/2012 | Albertsen et al. |
| 2012/0316007 | A1 | | 12/2012 | Burnett et al. |
| 2013/0123040 | A1 | | 5/2013 | Willett et al. |

OTHER PUBLICATIONS

Excerpts from Golf Digest; magazine; Feb. 2004; Article entitled: "The Hot List", cover page from magazine and article on pp. 82-88.

Excerpts from Golf Digest; magazine; Feb. 2005; Article entitled: "The Hot List", cover page from magazine and article on pp. 119-130. (Part 1).

Excerpts from Golf Digest; magazine; Feb. 2005; Article entitled: "The Hot List", article on pp. 131-143. (Part 2).

Excerpts from Golf Digest; magazine; Feb. 2006; Article entitled: "The Hot List", cover page from magazine and article on pp. 122-132. (Part 1).

Excerpts from Golf Digest; magazine; Feb. 2006; Article entitled: "The Hot List", article on pp. 133-143. (Part 2).

Excerpts from Golf Digest; magazine; Feb. 2007; Article entitled: "The Hot List", cover page from magazine and article on pp. 130-151.

Excerpts from Golf Digest; magazine; Feb. 2008; Article entitled: "The Hot List", cover page from magazine and article on pp. 114-139.

Excerpts from Golf Digest; magazine; Feb. 2009; Article entitled: "The Hot List", cover page from magazine and article on pp. 101-127.

International Searching Authority (USPTO), International Search Report and Written Opinion for International Application No. PCT/US2009/049418, mailed Aug. 26, 2009, 10 pages.

Declaration.

* cited by examiner

GOLF CLUB HEAD HAVING TRIP STEP FEATURE

CROSS-REFERENCE TO RELATED APPLICATIONS

This application is a divisional application of U.S. patent application Ser. No. 12/361,290, filed on Jan. 28, 2009 now abandoned, which claims the benefit of U.S. provisional patent application Ser. No. 61/080,892, filed on Jul. 15, 2008, and U.S. provisional patent application Ser No. 61/101,919, filed on Oct. 1, 2008, all of which are incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to sports equipment; particularly, to an aerodynamic golf club head having a trip step feature.

BACKGROUND OF THE INVENTION

Modem high volume golf club heads, namely drivers, are being designed with little, if any, attention paid to the aerodynamics of the golf club head. This stems in large part from the fact that in the past the aerodynamics of golf club heads were studied and it was found that the aerodynamics of the club head had only minimal impact on the performance of the golf club.

The drivers of today have club head volumes that are often double the volume of the most advanced club heads from just a decade ago. In fact, virtually all modem drivers have club head volumes of at least 400 cc, with a majority having volumes right at the present USGA mandated limit of 460 cc. Still, golf club designers pay little attention o the aerodynamics of these large golf clubs; often instead focusing solely on increasing the club head's resistance to twisting during off-center shots.

The modern race to design golf club heads that greatly resist twisting, meaning that the club heads have large moments of inertia, has led to club heads having very long front-to-back dimensions. The front-to-back dimension of a golf club head, often annotated the FB dimension, is measured from the leading edge of the club face to the furthest back portion of the club head. Currently, in addition to the USGA limit on the club head volume, the USGA limits the front-to-back dimension (FB) to 5 inches and the moment of inertia about a vertical axis passing through the club head's center of gravity (CG), referred to as MOIy, to 5900 g*cm$^2$. One of skill in the art will know the meaning of "center of gravity," referred to herein as CG, from an entry level course on mechanics, With respect to wood-type golf clubs, which are generally hollow and/or having non-uniform density, the CG is often thought of as the intersection of all the balance points of the club head. In other words, if you balance the head on the face and then on the sole, the intersection of the two imaginary lines passing straight through the balance points would define the point referred. to as the CG.

Until just recently the majority of drivers had what is commonly referred to as a "traditional shape" and a 460 cc club head volume. These large volume traditional shape drivers had front-to-back dimensions (F13) of approximately 4.0 inches to 4.3 inches, generally achieving an MOIy in the range of 4000-4600 g*cm$^2$. As golf club designers strove to increase MOIy as much as possible, the FB dimension of drivers started entering the range of 4.3 inches to 5.0 inches. The graph of FIG. 1 shows the FB dimension and MOIy of 83 different club head designs and nicely illustrates that high MOIy values come with large FB dimensions.

While increasing the FB dimension to achieve higher MOIy values is logical, significant adverse effects have been observed in these large PB dimension clubs. One significant adverse effect is a dramatic reduction in club head speed, which appears to have gone unnoticed by many in the industry. The graph of FIG. 2 illustrates player test data with drivers having an FB dimension greater than 3.6 inches. The graph illustrates considerably lower club head speeds for large FB dimension drivers when compared to the club head speeds of drivers having FB dimensions less than 4.4 inches. In fact, a club head speed of 104.6 mph was achieved when swinging a driver having a FB dimension of less than 3.8 inches, while the swing speed dropped over 3% to 101.5 mph when swinging a driver with a FB dimension of slightly less than 4.8 inches.

This significant decrease in club head speed is the result of the increase in aerodynamic drag forces associated with large FB dimension golf club heads. Data obtained during extensive wind tunnel testing shows a strong correlation between club head dimension and the aerodynamic drag measured at several critical orientations. First, orientation one is identified in FIG. 11 with a flow arrow labeled as "Air Flow—90° " and is referred to in the graphs of the figures as "lie 90 degree orientation." This orientation can be thought of as the club head resting on the ground plane (GP) with the shaft axis SA) at the club head's design lie angle, as seen in FIG. 8. Then a 100 mph wind is directed parallel to the ground plane (GP) directly at the club face (200), as illustrated by the flow arrow labeled "Air Flow—90°" in FIG. 11, Secondly, orientation two is identified in FIG. 11 with a flow arrow labeled as "Air Flow—60°" and is referred to in the graphs of the figures as "lie 60 degree orientation." This orientation can be thought of as the club head resting on the ground plane (GP) with the shaft axis (SA) at the club head's design lie angle, as seen in FIG. 8. Then a 100 mph wind is wind is oriented thirty degrees from a vertical plane normal to the face (200) with the wind originating from the heel (116) side of the club head, as illustrated by the flow arrow labeled "Air Flow—60°" in FIG. 11.

Thirdly, orientation three is identified in FIG. 12 with a flow arrow labeled as "Air Flow—Vert.—0°" and is referred to in the graphs of the figures as "vertical 0 degree orientation." This orientation can be thought of as the club head being oriented upside down with the shaft axis (SA) vertical while being exposed to a horizontal 100 mph wind directed at the heel (116), as illustrated by the flow arrow labeled "Air Flow—Vert.—0°" in FIG. 12. Thus, the air flow is parallel to the vertical plane created by the shaft axis (SA) seen in FIG. 11, blowing from the heel (116) to the toe (118) but with the club head oriented as seen in FIG. 12

Now referring back to orientation one, namely the orientation identified in FIG. 11 with a flow arrow labeled as "Air Flow—90°." Normalized aerodynamic drag data has been gathered for six different club heads and is illustrated in the graph of FIG. 5. At this point it is important to understand that all of the aerodynamic drag forces mentioned herein, unless otherwise stated, are aerodynamic drag forces normalized to a 120 mph airstream velocity. Thus, the illustrated aerodynamic drag force values are actual measured drag force at the indicated airstream velocity multiplied by the square of the reference velocity, which is 120 mph, then divided by the square of the actual airstream velocity. Therefore, the normalized aerodynamic drag force plotted in FIG. 5 is the actual measured drag force when subjected to a 100 mph wind at the specified orientation, multiplied by the square of the 120 mph reference velocity, and then divided by the square of the 100 mph actual airstream velocity.

Still referencing FIG. 5, the normalized aerodynamic drag force increases non-linearly from a low of 1.2 lbf with a short 3.8 iochFB dimension club head to a high of 2.65 lbf for a club head having a FB dimension of almost 4.8 inches. The increase in normalized aerodynamic drag force is in excess of 120% as the FB dimension increases slightly less than one inch, contributing to the signiticant decrease in club head speed previously discussed.

The results are much the same in orientation two, namely the orientation identified in FIG. 11 with a flow arrow labeled as "Air Flow—60°." Again, normalized aerodynamic drag data has been gathered for six different club heads and is illustrated in the graph of FIG. 4. The normalized aerodynamic drag force increases non-linearly from a low of approximately 1.1 lbf with a short 3.8 inch FB dimension club head to a high of approximately 1.9 lbf for a club head having a FB dimension of almost 4.8 inches. The increase in normalized aerodynamic drag force is almost 73% as the FB dimension increases slightly less than one inch, also contributing to the is significant decrease in club head speed previously discussed.

Again, the results are much the same in orientation three, namely the orientation identified in FIG. 12 with a flow arrow labeled as "Air Flow Vert.—0°." Again, normalized aerodynamic drag data has been gathered for several different club heads and is illustrated in the graph of FIG. 3. The normalized aerodynamic drag force increases non-linearly from a low of approximately 1.15 lbf with a short 3.8 inch FB dimension club head to a high of approximately 2.05 lbf for a club head having a FB dimension of almost 4.8 inches. The increase in normalized aerodynamic drag force is in excess of 78% as the FB dimension increases slightly less than one inch, also contributing to the significant decrease in club head speed previously discussed.

Further, the graph of FIG. 6 correlates the player test club head speed data of FIG. 2 with the maximum normalized aerodynamic drag force for each club head from FIG. 3, 4, or 5. Thus, FIG. 6 shows that the dub head speed drops from 104.6 mph, when the maximum normalized aerodynamic drag force is only 1.2 lbf, down to 101.5 mph, when the maximum normalized aerodynamic drag force is 2.65 lbf.

The drop in club head speed just described has a significant impact on the speed at which the golf ball leaves the club face after impact and thus the distance that the golf ball travels. In fact, for a club head speed of approximately 100 mph, each 1 mph reduction in club head speed results in approximately a 1% loss in distance. The present golf club head has identified these relationships, the reason for the drop in club head speed associated with long FB dimension clubs, and several ways to reduce the aerodynamic drag force of golf club heads.

SUMMARY OF THE INVENTION

The aerodynamic golf club head incorporates a trip step located on the crown section. The benefits associated with the reduction in aerodynamic drag force associated with the trip step may be applied to drivers, fairway woods, and hybrid type golf club heads having volumes as small as 75 cc and as large as allowed by the USG A at any point in time, currently 460 cc. The trip step is located between a crown apex and the back of the club head and may be continuous or discontinuous.

The trip step enables a significant reduction in the aerodynamic drag force exerted on the golf club head by forcing the air passing over the club head from laminar flow to turbulent flow just before the natural separation point of the airstream from the crown. This selectively engineered transition from laminar to turbulent flow over the crown section slightly increases the skin friction but results in less aerodynamic drag than if the air were to detach from the crown section at the natural separation point.

BRIEF DESCRIPTION OF THE DRAWINGS

Without limiting the scope of the claimed high volume aerodynamic golf club, reference is now given to the drawings and figures:

Figure 1:
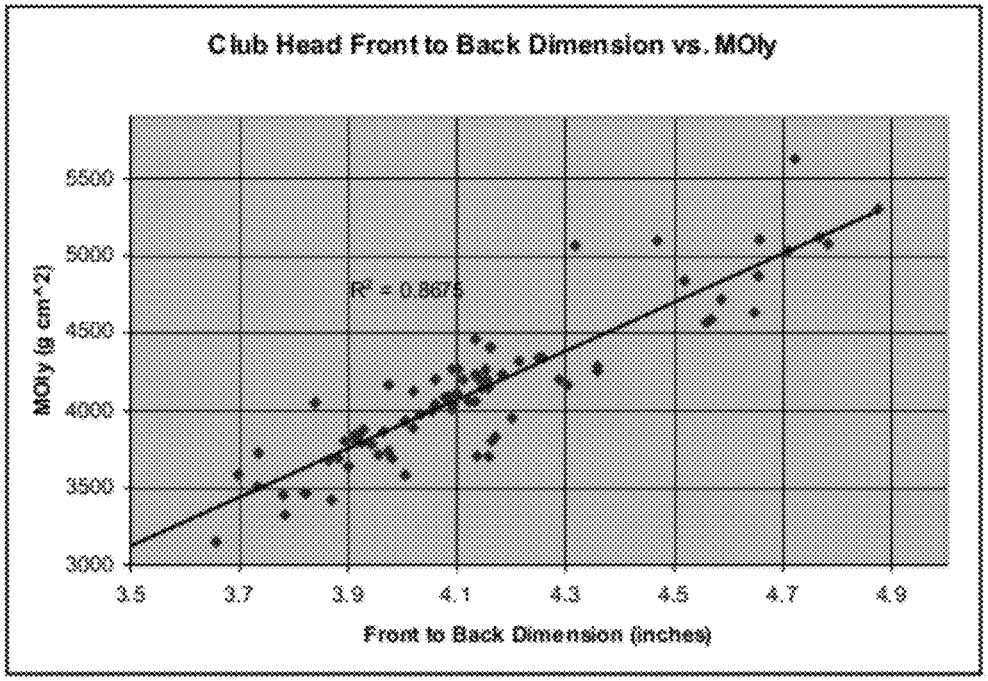
FIG. 1 shows a graph of FB dimensions versus MOIy.
Figure 2:
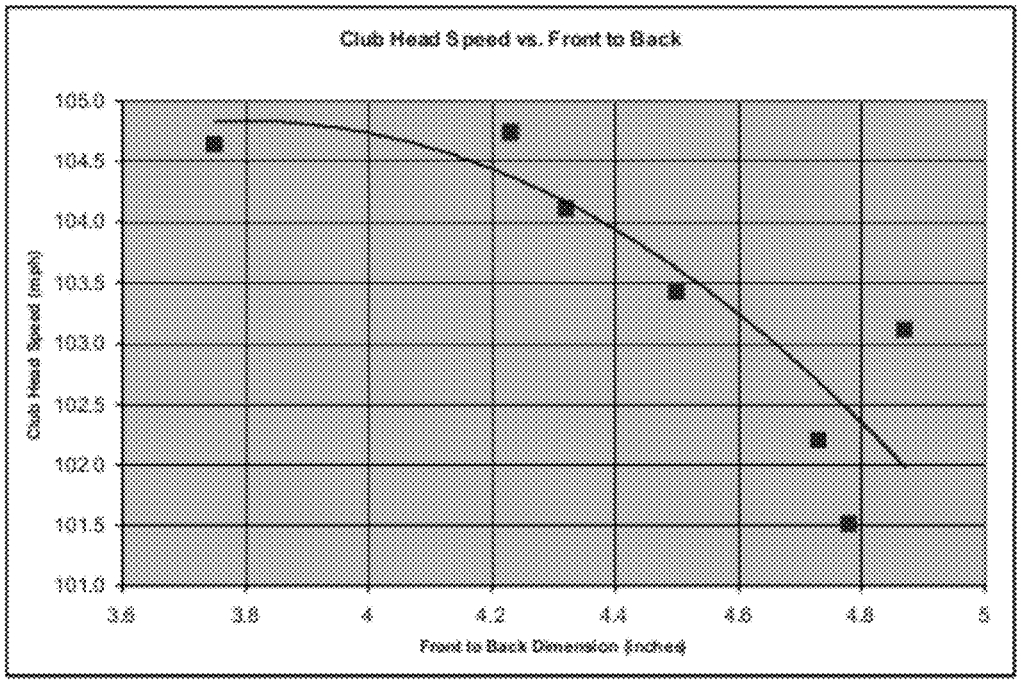
FIG. 2 shows a graph of FB dimensions versus club head speed.
Figure 3:
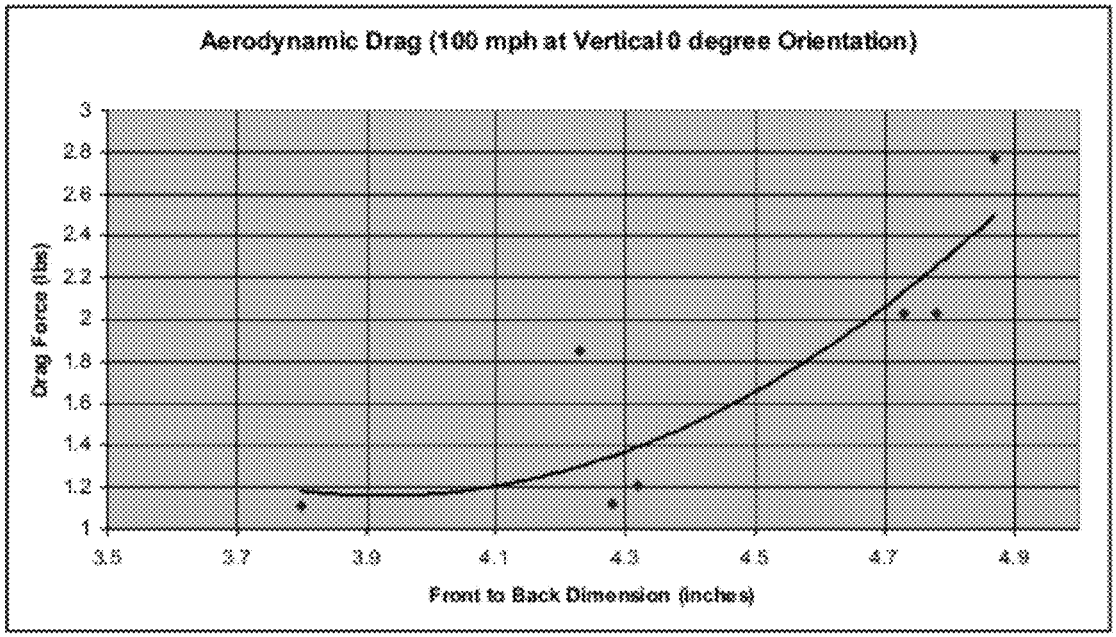
FIG. 3 shows a graph of FB dimensions versus club head normalized aerodynamic drag force.
Figure 4:
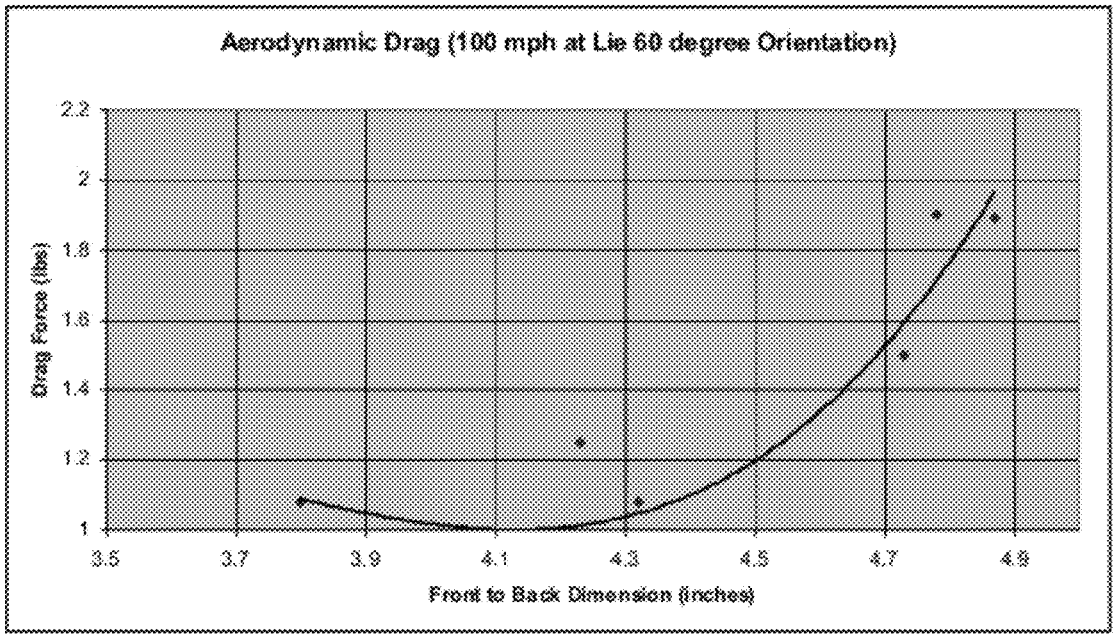
FIG. 4 shows a graph of FB dimensions versus club head normalized aerodynamic drag force.
Figure 5:
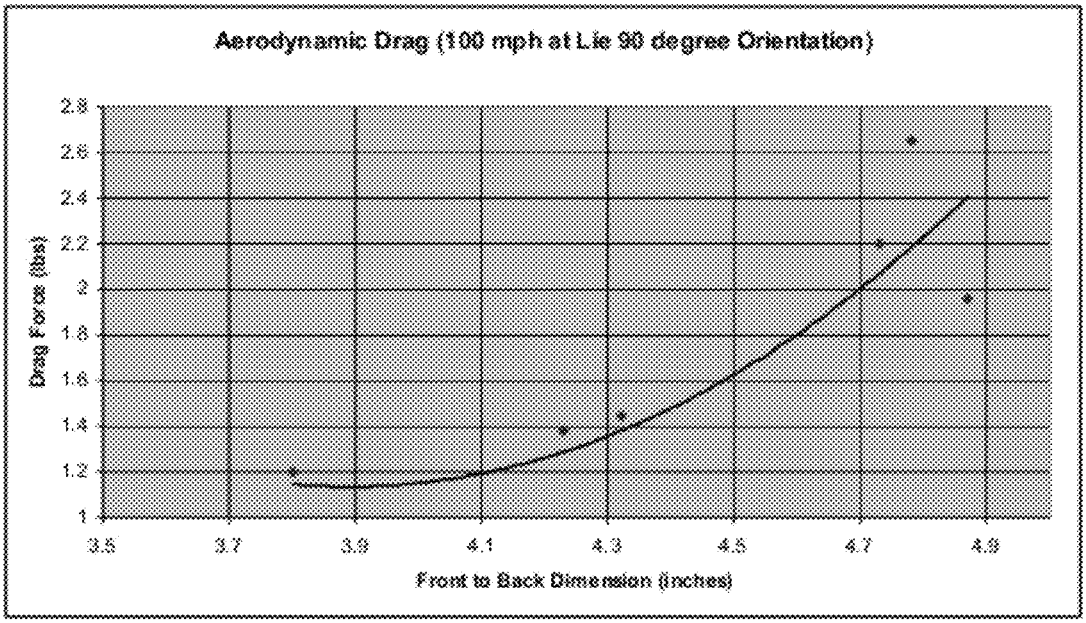
FIG. 5 shows a graph of FB dimensions versus club head normalized aerodynamic drag force.
Figure 6:
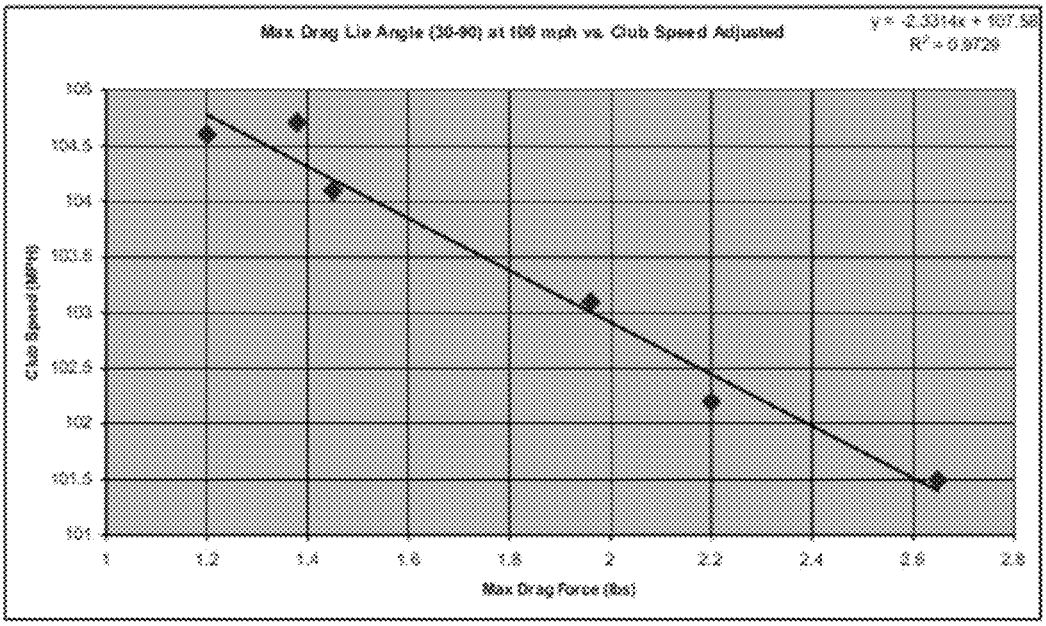
FIG. 6 shows a graph of club head normalized aerodynamic drag force versus club head speed.

These drawings are provided to assist in the understanding of the exemplary embodiments of the golf club head as described in more detail below and should not be construed as unduly limiting the claimed golf club head. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The claimed aerodynamic golf club head (100) enables a significant advance in the state of the art. The preferred embodiments of the aerodynamic golf club head (100) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the aerodynamic golf club head (100), and is not intended to represent the only form in which the aerodynamic golf club head (100) may be constructed or utilized. The description sets forth the designs, functions, means, and methods of implementing the aerodynamic golf club head (100) in connection with the illustrated embodiments. It is to be understood, however, that the same or equivalent functions and features may be accomplished by different embodiments that are also intended to be encompassed within the spirit and scope of the claimed aerodynamic golf club head (100).

The present aerodynamic golf club head (100) has recognized that the poor aerodynamic performance of large FB dimension drivers is not due solely to the large FB dimension; rather, in an effort to create large FB dimension drivers with a high MOIy value and low center of gravity (CG) dimension, golf club designers have generally created clubs that have very poor aerodynamic shaping. The main problems include significantly flat surfaces located incorrectly on the body, the lack of proper shaping to account for airflow attachment and reattachment in the areas trailing the face, the lack of proper trailing edge design, and failure to incorporate features that keep the airstream attached to the body as long as possible to further reduce aerodynamic drag. In addition, current large FB dimension driver designs have ignored, or even tried to maximize in some cases, the frontal cross sectional area of the golf club head which increases the aerodynamic drag force. The present golf club head (100) solves these issues.

In one of many embodiments disclosed herein, the present golf club head (100) has a volume of at least 400 cc. In this embodiment the golf club head (100) is characterized by a face-on normalized aerodynamic drag force of less than 1.5 lbf when exposed to a 100 mph wind parallel to the ground plane (GP) when the high volume aerodynamic golf club head (100) is positioned in a design orientation and the wind is oriented at the front (112) of the high volume aerodynamic golf club head (100), as previously described with respect to FIG. 11 and the flow arrow labeled "air flow—90°." As explained in the "Background" section, but worthy of repeating in this section, all of the aerodynamic drag forces mentioned herein, unless otherwise stated, are aerodynamic drag forces normalized to a 120 mph airstream velocity. Thus, the above mentioned normalized aerodynamic drag force of less than 1.5 lbf when exposed to a 100 mph wind is the actual measured drag force at the indicated 100 mph airstream velocity multiplied by the square of the reference velocity, which is 120 mph, then divided by the square of the actual airstream velocity, which is 100 mph.

Figure 7:
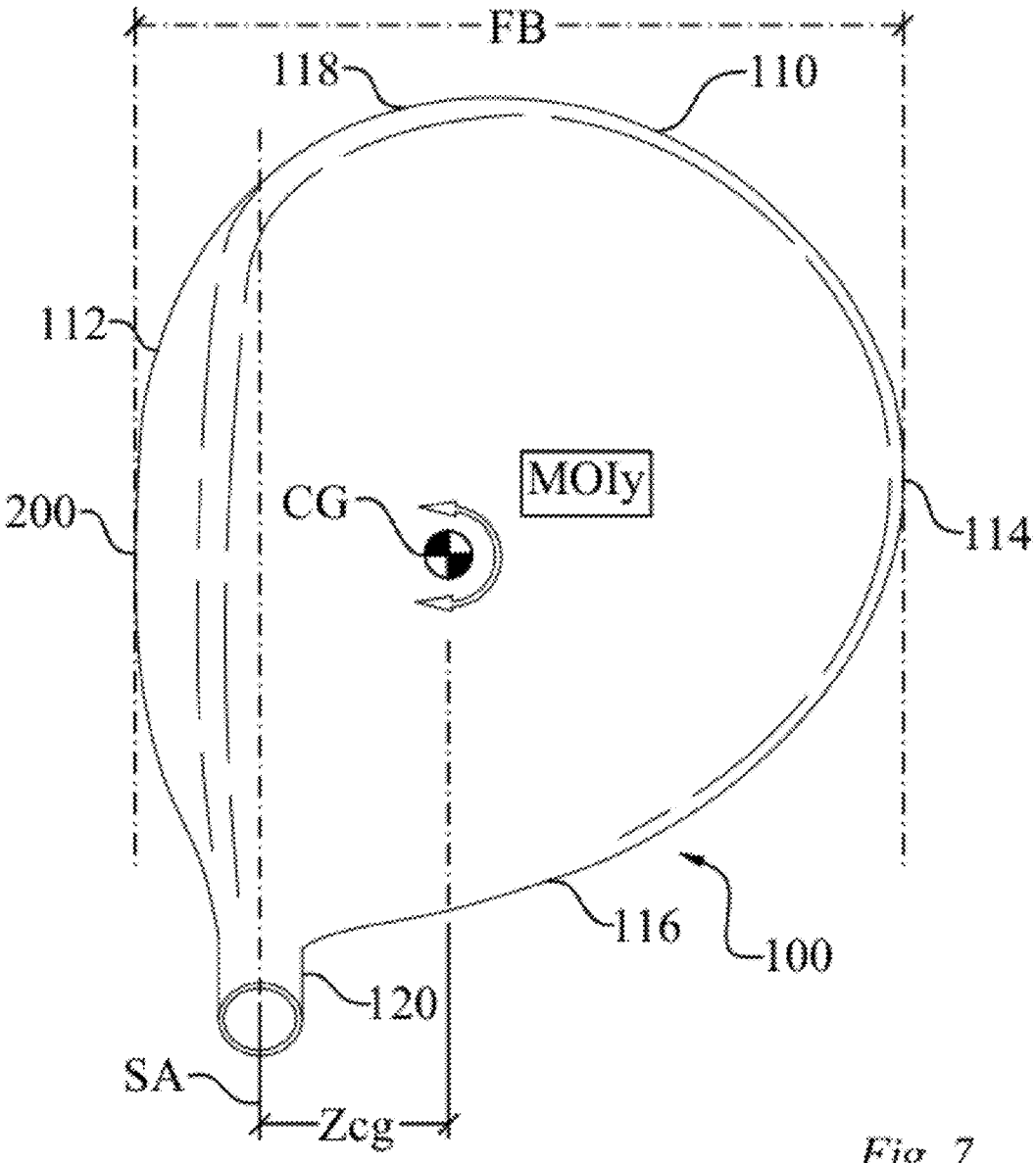
FIG. 7 shows a top plan view of an aerodynamic golf club head, not to scale.
Figure 8:
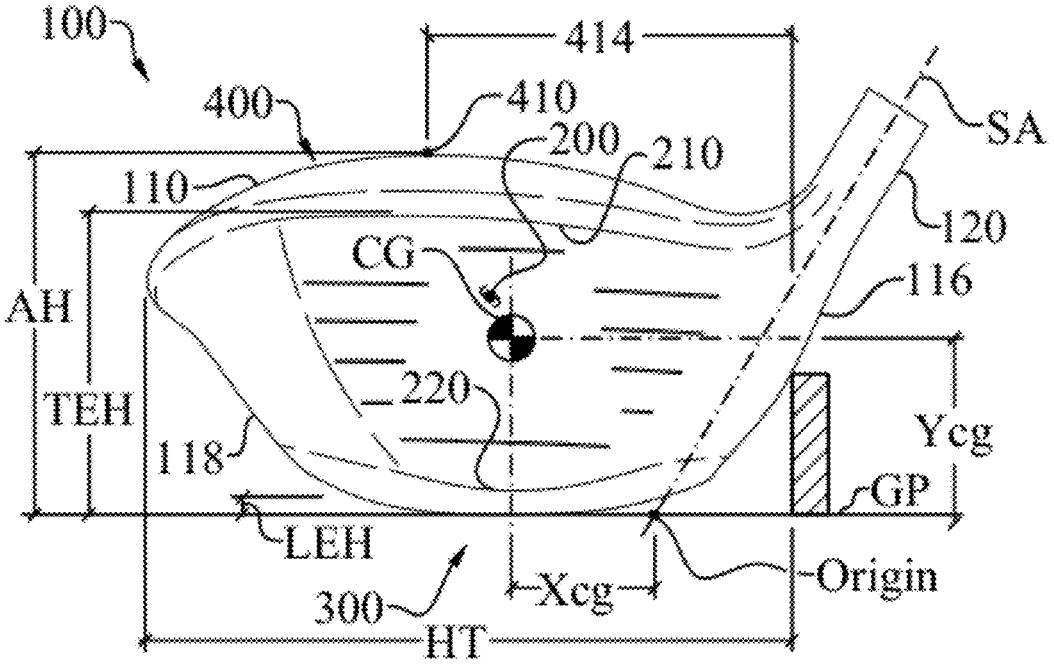
FIG. 8 shows a front elevation view of an aerodynamic golf club head, not to scale.
Figure 9:
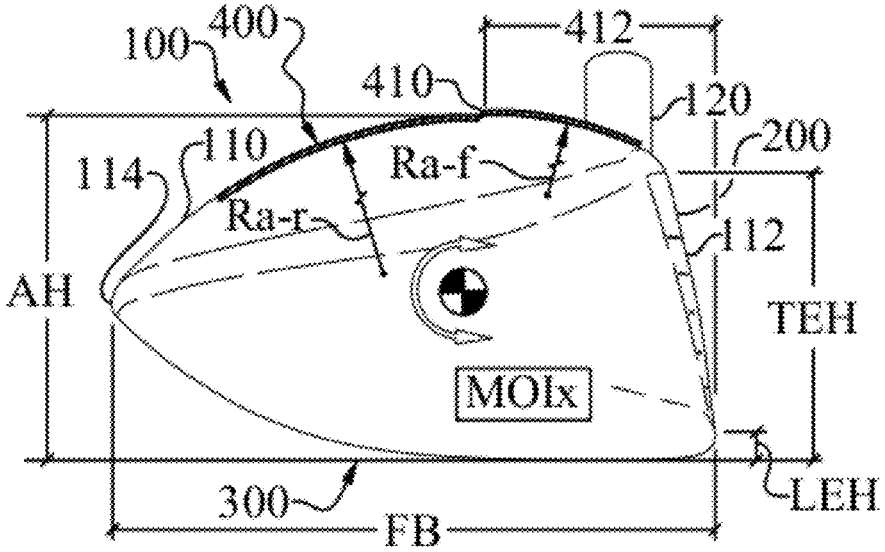
FIG. 9 shows a toe side elevation view of an aerodynamic golf club head, not to scale.

With general reference to FIGS. 7-9, the aerodynamic golf club head (100) includes a hollow body (110) having a face (200), a sole section (300), and a crown section (400). The hollow body (110) may be further defined as having a front (112), a back (114), a heel (116), and a toe (118). Further, in one particular embodiment, the hollow body (110) has a front-to-back dimension (FB) of at least 4.4 inches, as previously defined and illustrated in FIG. 7.

In yet another embodiment, a relatively large FB dimension allows the aerodynamic golf club head (100) to obtain beneficial moment of inertia values while Obtaining superior aerodynamic properties unseen by other large volume, large FB dimension, high MOI golf club heads. Specifically, in yet another embodiment, the golf club head (100) obtains a first moment of inertia (MOIy) about a vertical axis through a center of gravity (CG) of the golf club head (100), illustrated in FIG. 7, that is at least 4000 $g*cm^2$. MOIy is the moment of inertia of the golf club head that resists opening and closing moments induced by ball strikes towards the toe side or heel side of the face. Further, the present embodiment obtains a second moment of inertia (MOIx) about a horizontal axis through the center of gravity (CG), as seen in FIG. 9, that is at least 2000 $g*cm^2$. MOIx is the moment of inertia of the golf club head that resists lofting and delofting moments induced by ball strikes high or low on the face.

The present golf club head (100) obtains superior aerodynamic performance through the use of unique club head shapes and features. Referring now to FIG. 8, the crown section (400) has a crown apex (410) located an apex height (AH) above a ground plane (GP). The apex height (AH), as well as the location of the crown apex (410), play important roles in obtaining the desirable airflow reattachment and associated aerodynamic performance of the aerodynamic golf club head (100).

Figure 10:
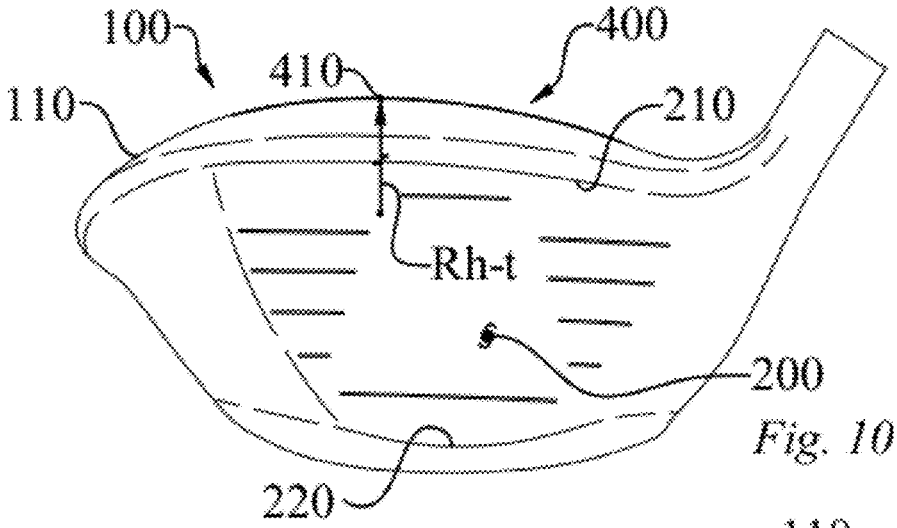
FIG. 10 shows a front elevation view of an aerodynamic golf club head, not to scale.

With reference now to FIGS. 9 and 10, the crown section (400) of the present embodiment has three distinct radii that improve the aerodynamic performance of the present golf club head (100). First, as seen in FIG. 9, a portion of the crown section (400) between the crown apex (410) and the front (112) has an apex-to-front radius of curvature (Ra-f) that is less than 3 inches. The apex-to-front radius of curvature (Ra-f) is measured in a vertical plane that is perpendicular to a vertical plane passing through the shaft axis, and the apex-to-front radius of curvature (RA-f ) is further measured at the point on the crown section (400) between the crown. apex (410) and the front (112) that has the smallest the radius of curvature.

Secondly, a portion of the crown section (400) between the crown apex (410) and the back (114) of the hollow body (110) has an apex-to-rear radius of curvature (Ra-r) that is less than 3.75 inches. The apex-to-rear radius of curvature (Ra-r) is also measured in a vertical plane that is perpendicular to a vertical plane passing through the shaft axis, and the apex-to-rear radius of curvature (Ra-r) is further measured at the point on the crown section (400) between the crown apex (410) and the back (112) that has the smallest the radius of curvature.

Lastly, as seen in FIG. 10, a portion of the crown section (400) has a heel-to-toe radius of curvature (Rh-t) at the crown apex (410) in a direction parallel to the vertical plane created by the shaft axis (SA) that is less than 4 inches. Such small radii of curvature have traditionally been avoided in the design of high volume golf club heads, especially in the design of high volume golf club heads having FB dimensions of 4.4 inches and greater. However, it is these tight radii that facilitate airflow reattachment as close to the face (200) as possible, thereby resulting reduced aerodynamic drag forces and higher club head speed.

Conventional high volume large MOIy golf club heads having large FB dimensions, such as those seen in USPN D544939 and USPN D543600, have relatively fiat crown sections that often never extend above the face. While these designs appear as though they should cut through the air, the opposite is often true with such shapes achieving poor airflow reattachment characteristics and increased aerodynamic drag forces. The present golf club head (100) has recognized the significance of proper club head shaping to account for airflow reattachment in the crown section (400) trailing the face (200), which is quite the opposite of the fiat, steeply sloped crown sections of many prior art large FB dimension club heads. The crown section (400) of the present golf club head (100) will be described in greater detail later herein.

With reference now to FIG. 10, the face (200) has a top edge (210) and a tower edge (220). Further, as seen in FIGS. 8 and 9, the top edge (210) has a top edge height (TEH) that is the elevation of the top edge (210) above the ground plane (GP). Similarly, the lower edge (220) has a lower edge height (LEH) that is the elevation of the lower edge (220) above the ground plane (GP). The highest point along the top edge (210) produces a maximum top edge height (TEH) that is at least 2 inches. Similarly, the lowest point along the tower edge (220) is a minimum lower edge height (LEH).

One of many significant advances of this embodiment is the design of an apex ratio that encourages airflow reattachment on the crown section (400) of the golf club head (100) as close to the face (200) as possible. In other words, the sooner that airflow reattachment is achieved the better the aerodynamic performance and the smaller the aerodynamic drag force. The apex ratio is the ratio of apex height (AH) to the maximum top edge height (TEH). As previously explained, in many large FB dimension golf club heads the apex height (AH) is no more than the top edge height (TEH). In this embodiment, the apex ratio is at least 1.13, thereby encouraging airflow reattachment as soon as possible.

Figure 13:
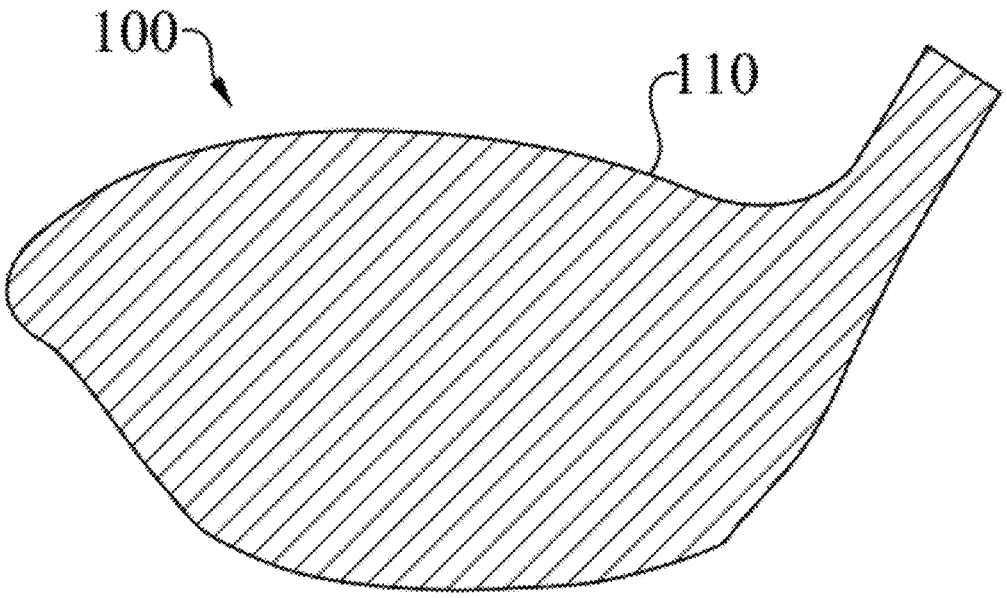
FIG. 13 shows a front elevation view of an aerodynamic golf club head, not to scale.

Still further, another embodiment of the golf club head (100) further has a frontal cross sectional area that is less than 11 square inches. The frontal cross sectional area is the single plane area measured in a vertical plane bounded by the outline of the golf club head when it is resting on the ground plane (GP) at the design lie angle and viewed from directly in front of the face (200). The frontal cross sectional area is illustrated by the cross-hatched area of FIG. 13.

Figure 11:
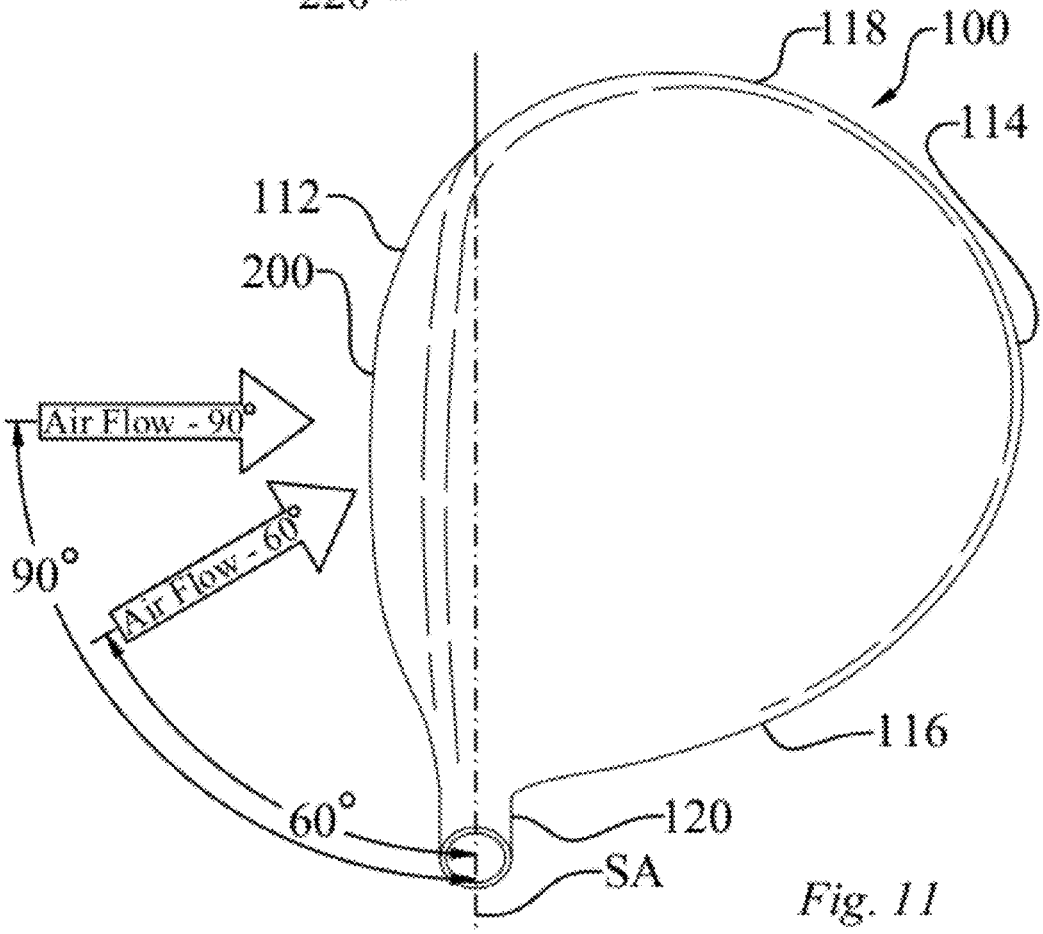
FIG. 11 shows a top plan view of an aerodynamic golf club head, not to scale.

In yet a further embodiment, a second aerodynamic drag force is introduced, namely the 30 degree offset formalized aerodynamic drag force, as previously explained with reference to FIG. 11. In this embodiment the 30 degree offset normalized aerodynamic drag force is less than 1.3 lbf when exposed to a 100 mph wind parallel to the ground plane (GP) when the aerodynamic golf club head (100) is positioned in a design orientation and the wind is oriented thirty degrees from a vertical plane normal to the face (200) with the wind originating from the heel (116) side of the aerodynamic golf club head (100). In addition to having the face-on normalized aerodynamic drag force less than 15 lbf, introducing a 30 degree offset normalized aerodynamic drag force of less than 1.3 lbf further reduces the drop in club head speed. associated with large volume, large FB dimension golf club heads.

Figure 12:
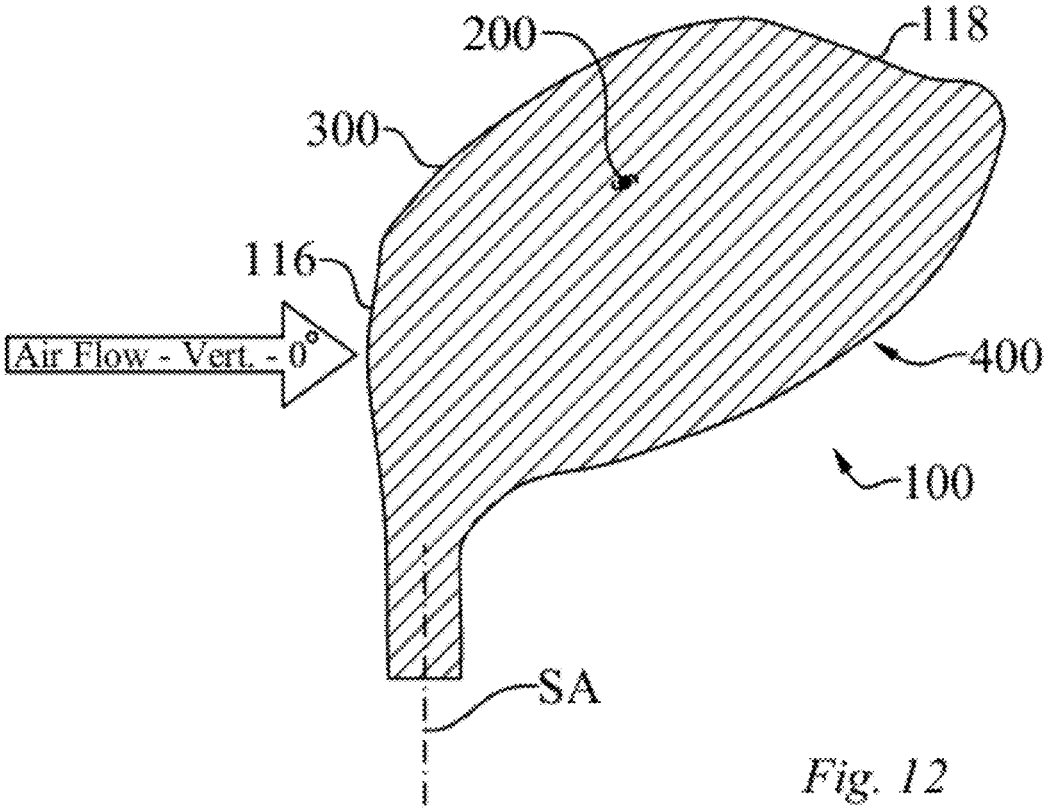
FIG. 12 shows a rotated front elevation view of an aerodynamic golf club head with a vertical shaft axis orientation, not to scale.

Yet another embodiment introduces a third aerodynamic drag force, namely the heel normalized aerodynamic drag force, as previously explained with reference to FIG. 12. In this particular embodiment, the heel normalized aerodynamic drag force is less than 1.9 lbf when exposed to a horizontal 100 mph wind directed at the heel (116) with the body (110) oriented to have a vertical shaft axis (SA). In addition to having the face-on normalized aerodynamic drag force of less than 1.5 lbf and the 30 degree offset normalized aerodynamic drag force of less than 1.3 lbf, having a heel normalized aerodynamic drag force of less than 1.9 lbf further reduces the 2V drop in club head speed associated with large volume, large FB dimension golf club heads.

A still further embodiment has recognized that having the apex-to-front radius of curvature (Ra-f) at least 25% less than the apex-to-rear radius of curvature (Ra-r) produces a particularly aerodynamic golf club head (100) further assisting in airflow reattachment. Yet another embodiment further encourages quick airflow reattachment by incorporating an apex ratio of the apex height (AH) to the maximum top edge height (TEH) that is at least 1.2. This concept is taken even further in yet another embodiment in which the apex ratio of the apex height (AH) to the maximum top edge height (TEH) is at least 1.25.

Reducing aerodynamic drag by encouraging airflow reattachment, or conversely discouraging extended lengths of airflow separation, may be further obtained in yet another embodiment in which the apex-to-front radius of curvature (Ra-f) is less than the apex-to-rear radius of curvature (Ra-r), and the apex-to-rear radius of curvature (Ra-r) is less than the heel-to-toe radius of curvature (Rh-t). Such a shape is contrary to conventional high volume, long FB dimension golf club heads, yet produces a particularly aerodynamic shape.

Taking this embodiment a step further in another embodiment, a golf club head (100) having the apex-to-front radius of curvature (Ra-f) less than 2.85 inches and the heel-to-toe radius of curvature (Rh-t) less than 3.85 inches produces an even smaller face-on aerodynamic drag force. Another embodiment focuses on the playability of the high volume aerodynamic golf club head (100) by having a maximum top edge height (TEH) that is at least 2 inches, thereby ensuring that the face area is not reduced to an unforgiving level. Even further, another embodiment incorporates a maximum top edge height (TEH) that is at least 2.15 inches.

The foregoing embodiments may be utilized having even larger FB dimensions. For example, the previously described aerodynamic attributes may be incorporated into an embodiment having a front-to-back dimension(FB) that is at least 4.6 inches, or even further a front-to-back dimension (FB) that is at least 4.75 inches. These embodiments allow the present aerodynamic golf club head (100) to obtain even higher MOIy values without reducing club head speed due to excessive aerodynamic drag forces.

Yet a further embodiment balances all of the radii of curvature requirements to obtain an aerodynamic golf club head (100) while minimizing the risk of an unnatural appearing golf club head by ensuring that less than 10% of the club head volume is above the elevation of the maximum top edge height (TEE). A further embodiment accomplishes the goals herein with a golf club head having between 5% to 10% of the club head volume located above the elevation of the maximum top edge height (TEH). This range achieves the desired crown apex (410) and radii of curvature to ensure desirable aerodynamic drag while maintaining an aesthetically pleasing took of the golf club head (100). The location of the crown apex (41)) is dictated to a degree by the apex-to-front radius of curvature (Ra-f); however, yet a further embodiment identifies that the crown apex (410) should be behind the forwardmost point on the face (200) a distance that is a crown apex setback dimension (412), seen in FIG. 9, which is greater than 10% of the FB dimension and less than 70% of the FB dimension, thereby further reducing the period of airflow separation. One particular embodiment within this range incorporates a crown apex setback dimension (412) that is less than 1.75 inches. An oven further embodiment balances playability with the volume shift toward the face associated with the present embodiment by positioning the performance mass to produce a center of gravity (CG) further away from the forwardmost point on the face (200) than the crown apex setback dimension (412).

Additionally, the heel-to-toe location of the crown apex (410) also plays a significant role in the aerodynamic drag force. The location of the crown apex (410) in the heel-to-toe direction is identified by the crown apex ht dimension (414), as seen in FIG. 8. This figure also introduces a heel-to-toe (HT) dimension which is measured in accordance with USGA rules. The location of the crown apex (410) is dictated to a degree by the heel-to-toe radius of curvature (Rh-t); however, yet a further embodiment identifies that the crown apex (410) location should result in a crown apex ht dimension (414) that is greater than 30% of the HT dimension and less than 70% of the HT dimension, further reducing the period of airflow separation. In an even further embodiment, the crown apex (410) is located in the heel-to-toe direction between the center of gravity (CG) and the to (118).

While the present aerodynamic golf club head (100) need not have a minimum club head volume, the reduction in aerodynamic drag force increases as the club head volume increases. Thus, while one embodiment is disclosed as having a club head volume of at least 400 cc, further embodiments incorporate the various features of the above described embodiments and increase the club head volume to at least 440 cc, or even further to the current USGA limit of 460 cc. However, one skilled in the art will appreciate that the specified radii and aerodynamic drag requirements are not limited to these club head sizes and apply to even larger club head volumes. Likewise, in one embodiment a heel-to-toe (HT) dimension, as seen in FIG. 8, is greater than the FB dimension, as measured in accordance with USGA rules.

Now, we turn our attention to further embodiments of the aerodynamic golf club head (100) that incorporate aerodynamic features solely, or in addition to the aerodynamic shaping previously discussed. The benefits of such aerodynamic features may be applied to drivers, fairway woods, and hybrid type golf club heads having volumes as small as 75 cc and as large as allowed by the USGA at any point in time, currently 460 cc, With reference to FIGS. 14-33, these embodiments of the aerodynamic golf club head (100) incorporate a trip step (500) located on the crown section (400).

As noted in the prior disclosure with reference to FIGS. 7-9, the crown section (400) has a crown apex (410) located an apex height (AH) above the ground plane (GP), As seen in FIGS. 14-19 and 23-30, the crown section (400) has the trip step (500) located between the crown apex. (410) and the back (114). It is important to note that the trip step (500) may be continuous, however the trip step (500) may be comprised of many individual features that together form a discontinuous trip step (500)as seen in FIG. 29, which illustrates three examples of discontinuous trip steps (500).

The trip step (500) is characterized by a trip step heel end (550), a trip step toe end (560), and a trip step thickness (540). The trip step heel end (550) merely refers to the fact that it is the end of the trip step (500) nearest the heel (116), and likewise the trip step toe end (560) merely refers to the fact that is it the end of the trip step (500) nearest the toe (118). Thus, the trip step (500) need only extend across a portion of the club head (100), and need not extend all the way from the heel (116) to the toe (118). Additionally, in one embodiment a trip step leading edge (510), located on the edge of the trip step (500) closest to the face (200), is separated from a trip step trailing edge (520), located on the edge of the trip step (500) closest to the back (114), by a trip step width (530). The trip step leading edge (510) has a leading edge profile (512), and likewise, in this embodiment, the trip step trailing edge 520) has a trailing edge profile (522).

Figure 29:
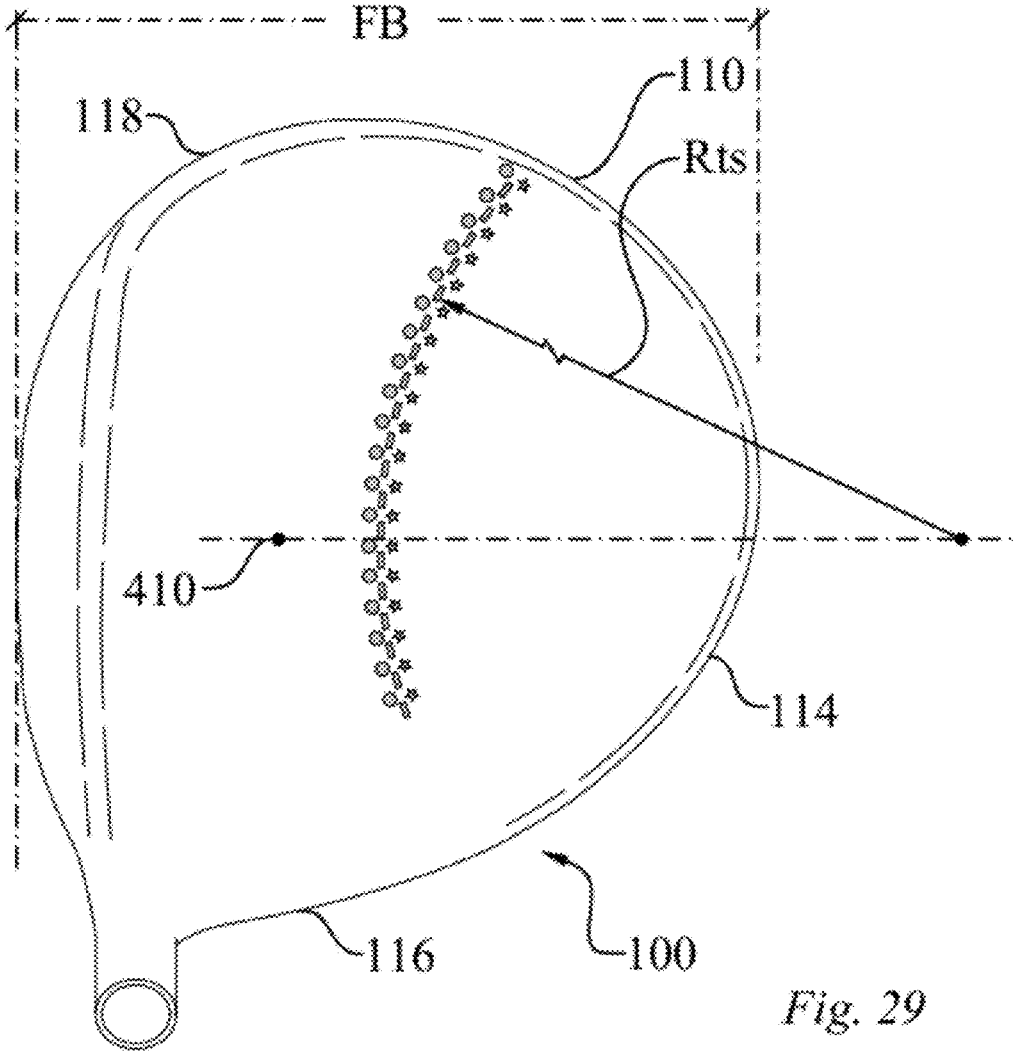
FIG. 29 shows a top plan view of an aerodynamic golf club head having a trip step, not to scale.
Figure 30:
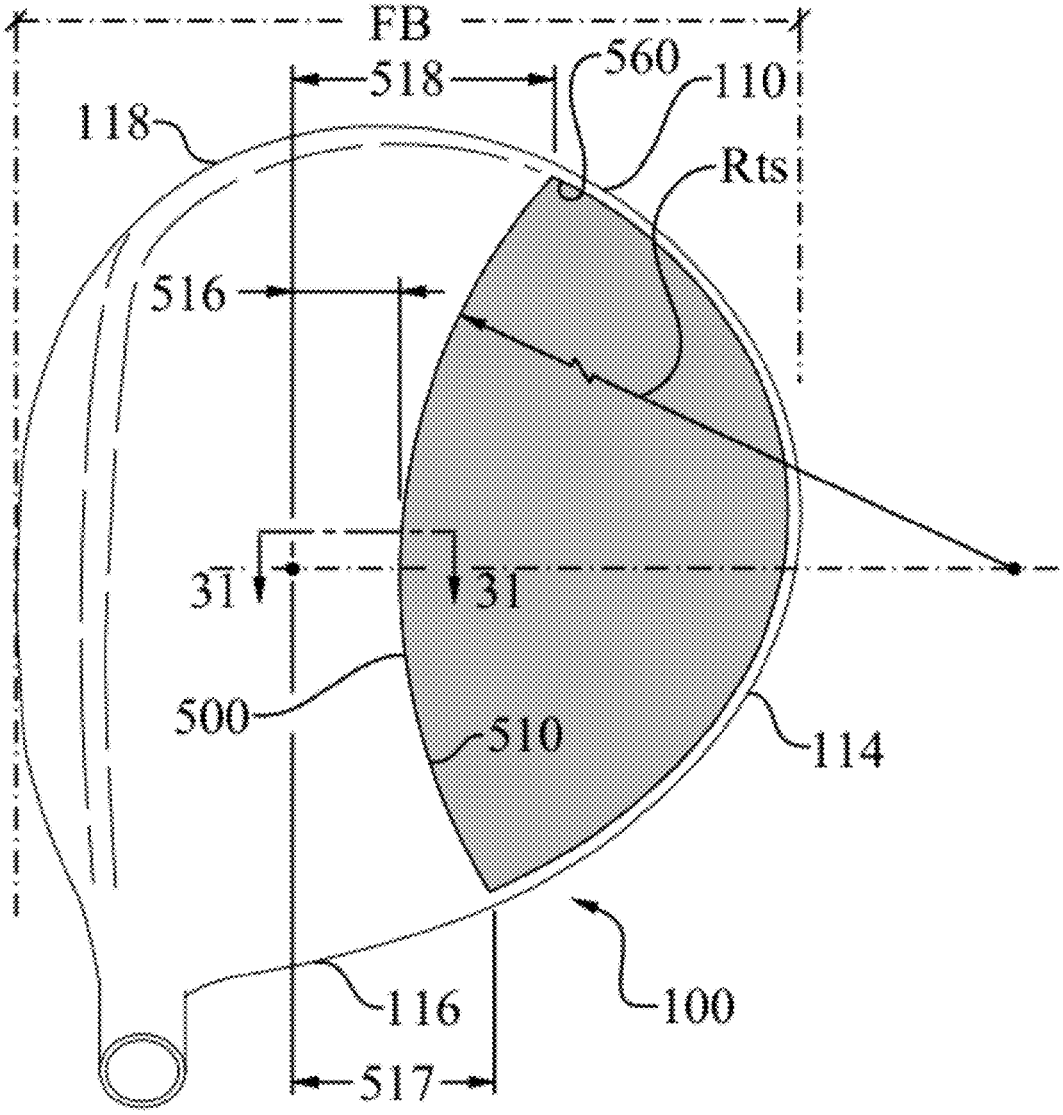
FIG. 30 shows a top plan view of an aerodynamic golf club head having a trip step, not to 1.5 scale.

In the embodiments of the present golf club head (100) that incorporate a discontinuous trip step (500), such as that seen in FIG. 29, the trip step leading edge (510) is an imaginary edge connecting the forward most point on each of the individual trip step features. For example, assuming the club head (100) of FIG. 29 only contains the circular trip step features, then the trip step leading edge (510) is an imaginary line connecting the point on the circumference of each circular trip step feature that is nearest a vertical plane defined by the shaft axis (SA). Likewise, the trip step trailing edge (520) is an imaginary edge connecting the rearward most point on each of the individual trip step features. Thus, again using the example of the circular trip step features of FIG. 29, the trip step trailing edge (520) is an imaginary line connecting the point on the circumference of each circular trip step feature that is farthest from the vertical plane defined by the shaft axis (SA).

The same is true regardless of the shape of the individual trip step features, which may include rectangular and star shaped projections or indentations as seen in FIG. 29, as well as individual trip step features in the shape of triangles, polygons, including, but not limited to, concave polygons, constructible polygons, convex polygons, cyclic polygons, decagons, digons, dodecagons, enneagons, equiangular polygons, equilateral polygons, henagons, hendecagons, heptagons, hexagons, Lemoine hexagons, Tucker hexagons, icosagons, octagons, pentagons, regular polygons, stars, and star polygons; triangles, including, but not limited to, acute triangles, anticomplementary triangles, equilateral triangles, excentral triangles, tritangent triangles, isosceles triangles, medial triangles, auxiliary triangles, obtuse triangles, rational triangles, right triangles, scalene triangles, Reuleaux triangles; parallelograms, including, but not limited to, equilateral parallelograms: rhombuses, rhomboids, and Wittenbauer's parallelograms; Penrose tiles; rectangles; rhombus; squares;

trapezium; quadrilaterals, including, but not limited to, cyclic quadrilaterals, tetrachords, chordal tetragons, and Brahmagupta's trapezium; equilic quadrilateral kites; rational quadrilaterals; strombus; tangential quadrilaterals; tangential tetragons; trapezoids; polydrafters; annulus; arbelos; circles; circular sectors; circular segments; crescents; tunes; ovals; Reuleaux polygons; rotors; spheres; semicircles; triquetras; Archimedean spirals; astroids; paracycles; cubocycloids; deltoids; ellipses; smoothed octagons; super ellipses; and tomahawks; polyhedra; prisms; pyramids; and sections thereof, just to name a few.

Figure 14:
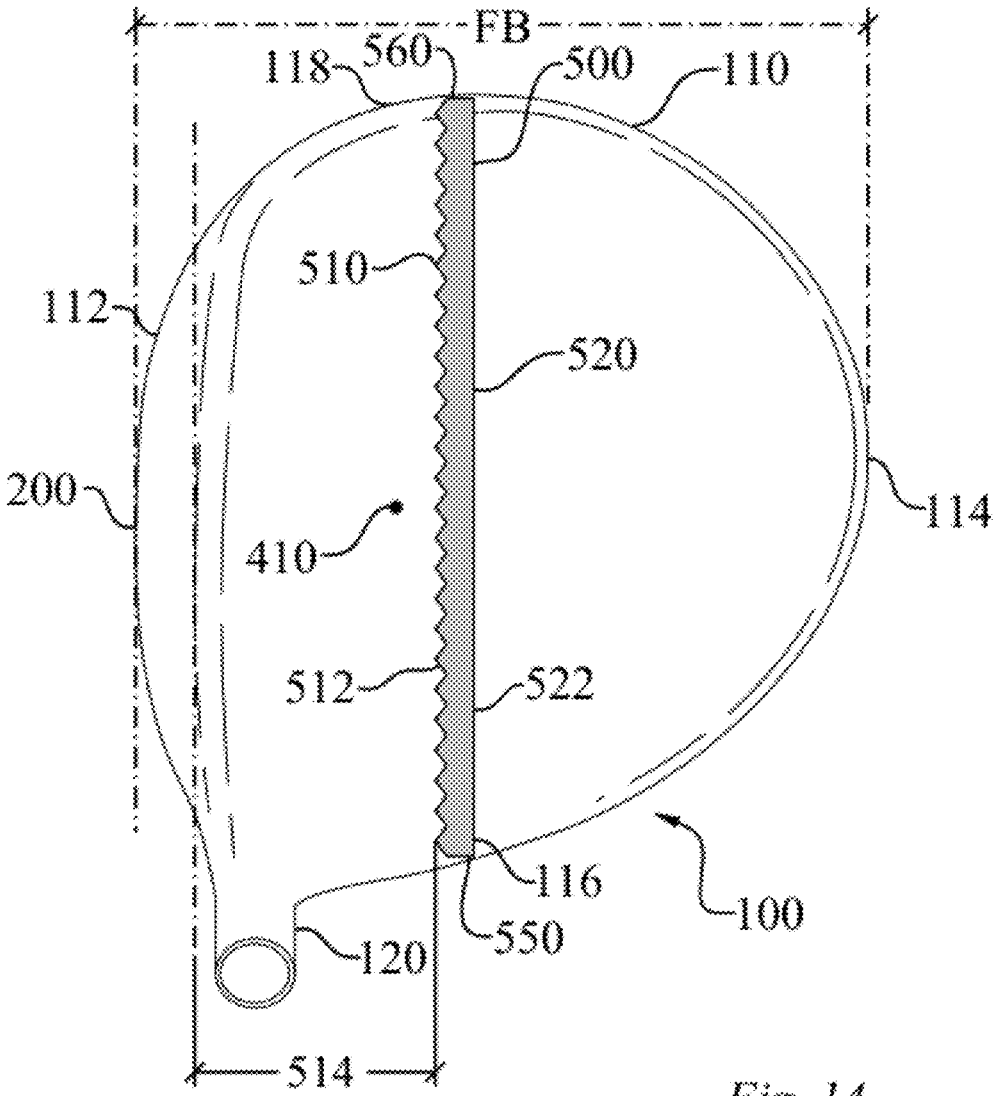
FIG. 14 shows a top plan view of an aerodynamic golf club head having a trip step, not to scale.
Figure 15:
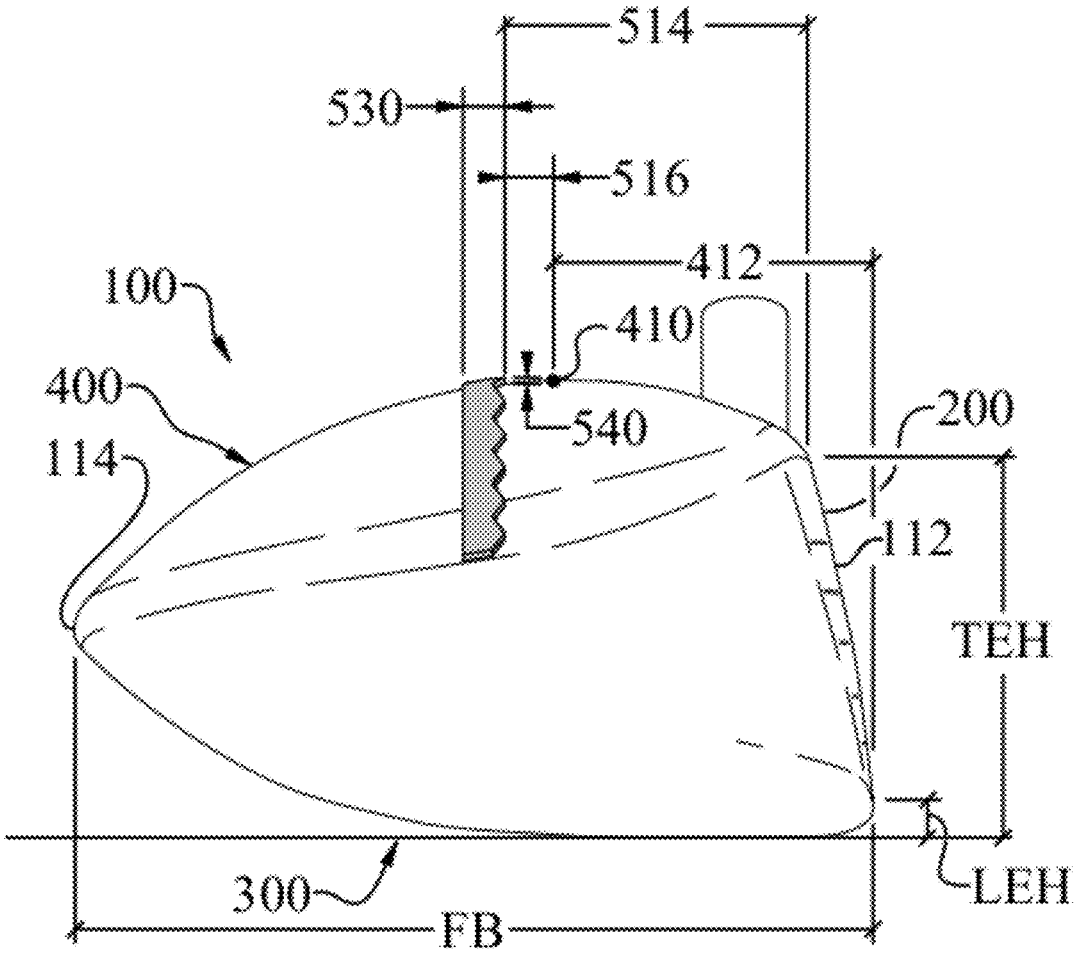
FIG. 15 shows a toe side elevation view of an aerodynamic golf club head having a trip step, not to scale.
Figure 17:
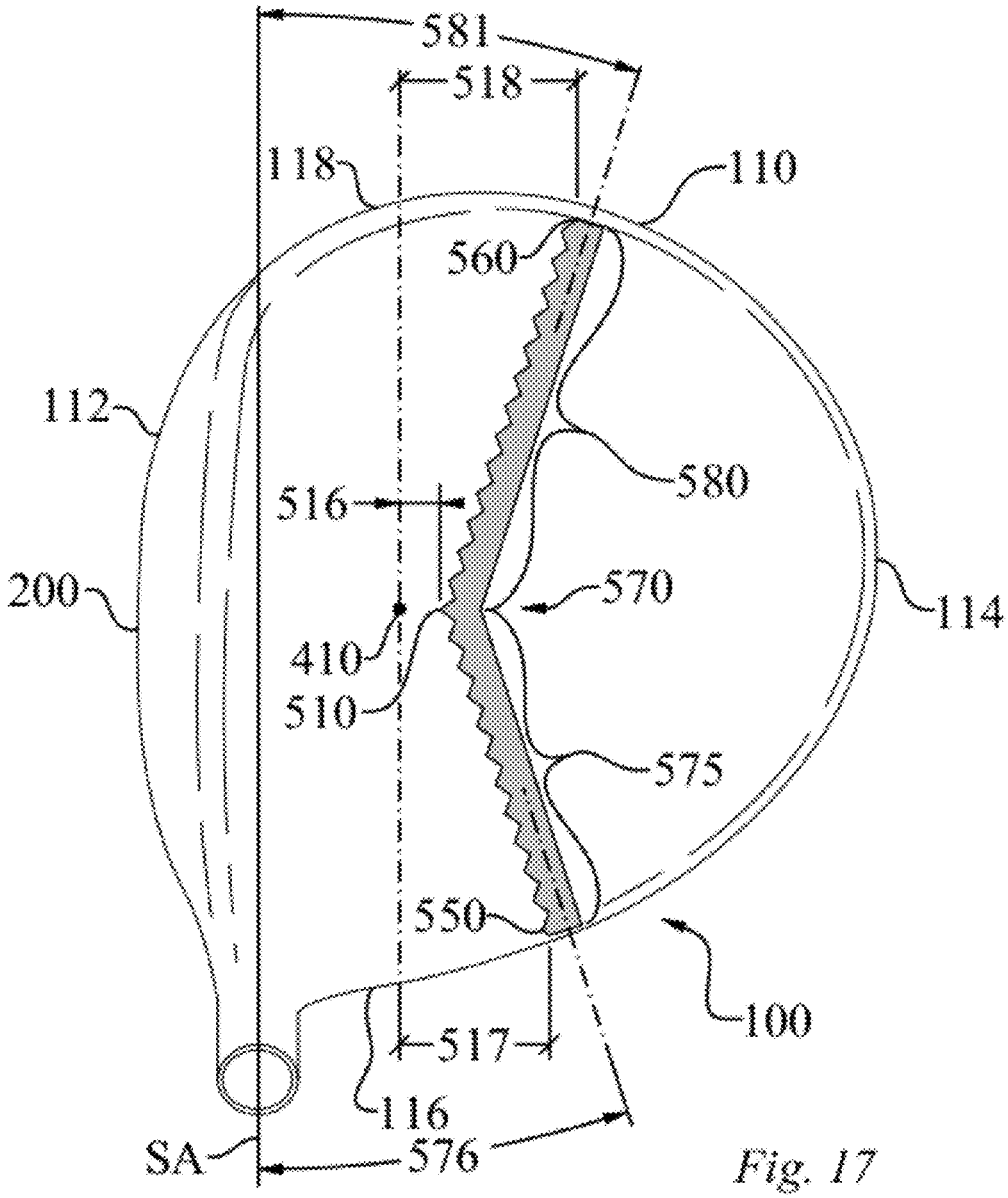
FIG. 17 shows a top plan view of an aerodynamic golf club head having a trip step, not to scale.
Figure 19:
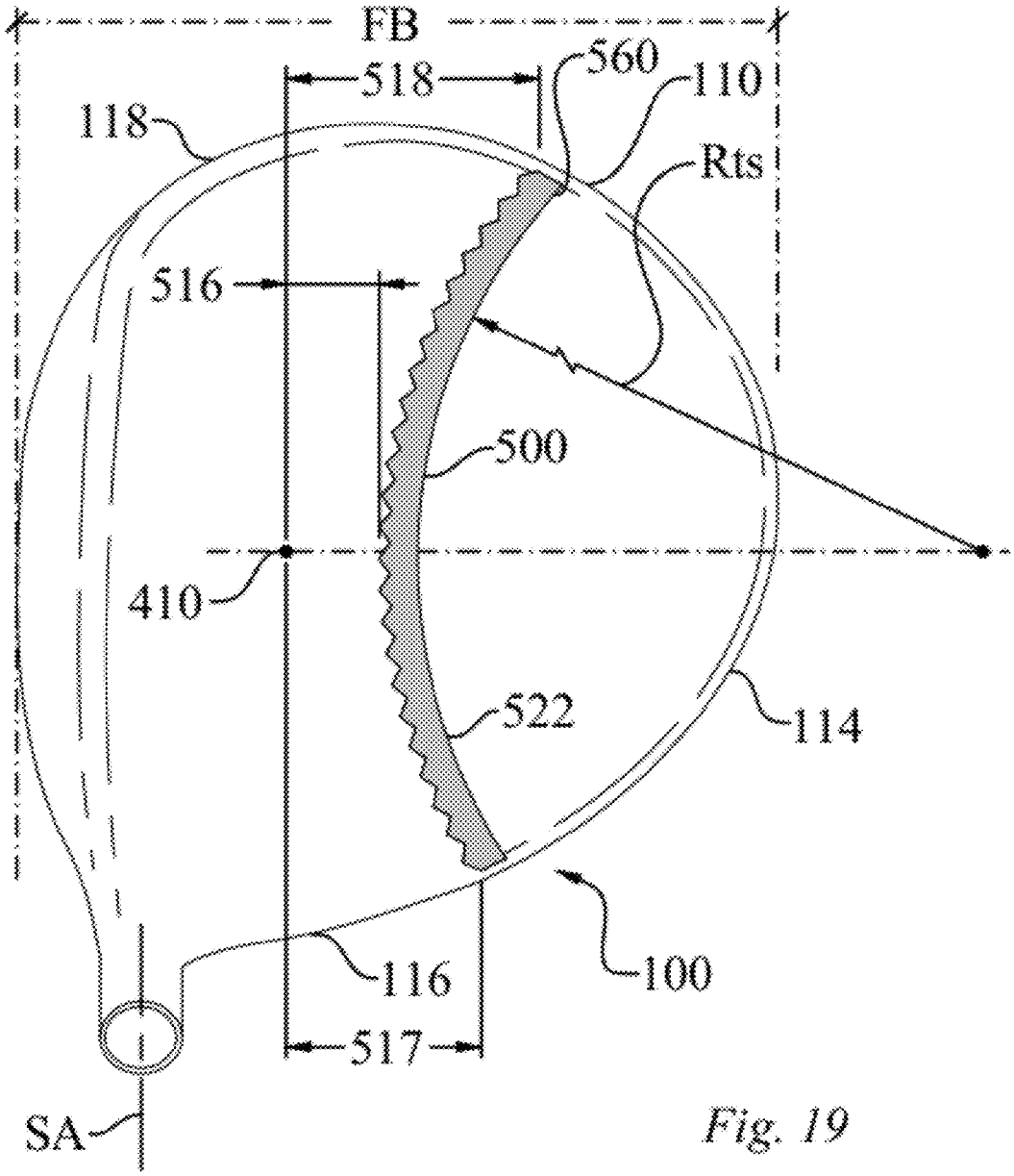
FIG. 19 shows a top plan view of an aerodynamic golf club head having a trip step, not to scale.

As previously mentioned, the trip step (500) is located between the crown apex (410) and the back (114); as such, several elements are utilized to identify the location of the trip step (500). As seen in FIGS. 14 and 15, the trip step leading edge (510) is located a trip step offset (514) behind the forwardmost point of the face top edge (210) in a direction perpendicular to a vertical plane through the shaft axis (SA). Further, as seen in FIG. 15, the trip step (500) conforms to the curvature of the crown section (400) and is located behind the crown apex (410) an apex-to-leading edge offset (516), also measured in a direction perpendicular to a vertical. plane through the shaft axis (SA). Additionally, as seen in FIGS. 17 and 19, the trip step leading edge (510) at the trip step heel end (550) is located behind the crown apex (410) an apex-to-heel LE offset (517), and likewise, the trip step leading edge (510) at the trip step toe end (560) is located behind the crown apex (410) an apex-to-toe LE offset (518). Thus, in the straight-line embodiment of FIGS. 14-15 the apex-to-heel LE offset (517) and the apex-to-toe LE offset (518) are equal to the apex-to-leading edge offset (516).

Figure 20:
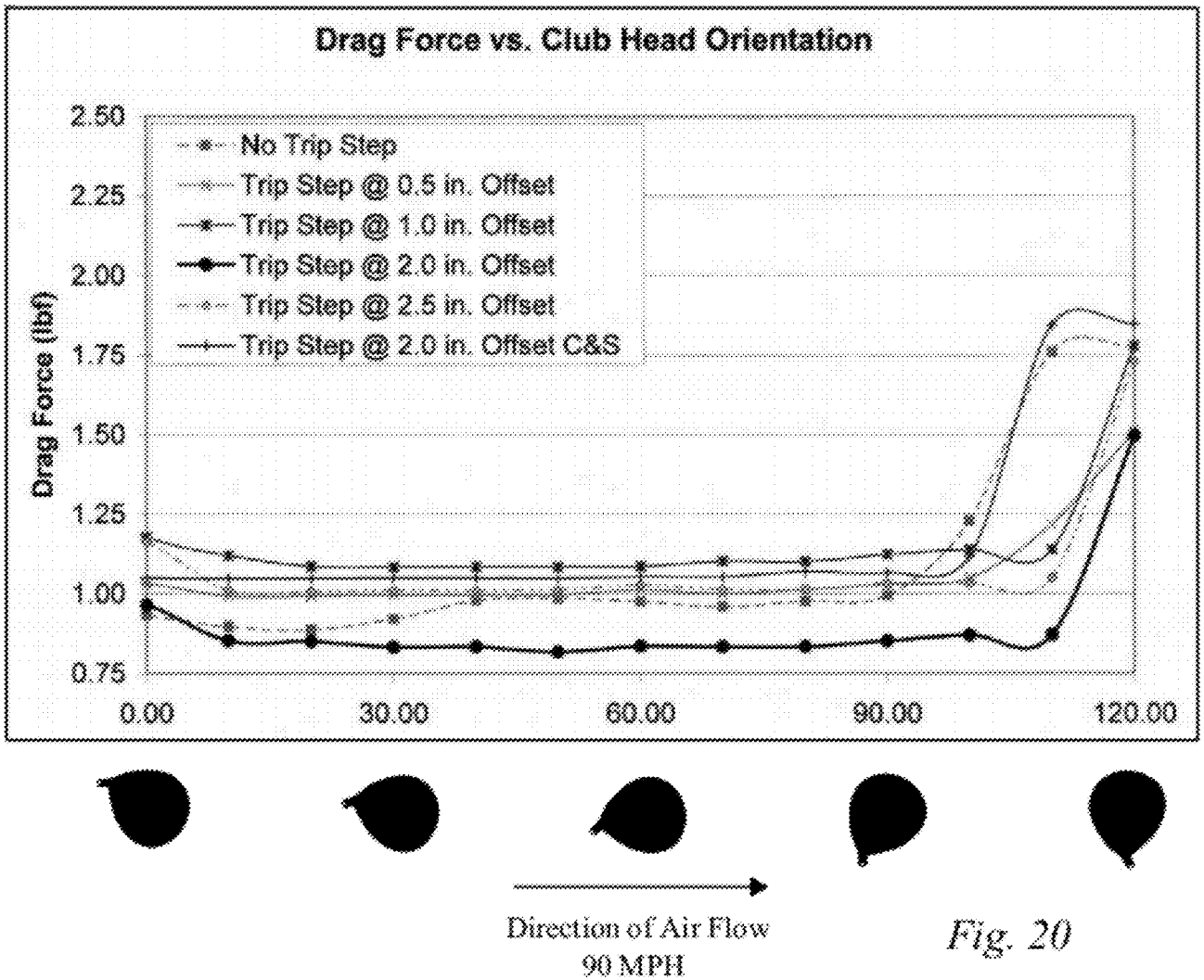
FIG. 20 shows a graph of normalized aerodynamic drag force versus club head orientation for three different configurations at 90 miles per hour.

The trip step (500) enables significant reduction in the aerodynamic drag force exerted on the golf club head (100). For instance, FIG. 20 is a graph illustrating the normalized aerodynamic drag force measured when a golf club head is exposed to a 90 mph wind in various positions. The graph illustrates the results for the high volume aerodynamic golf club head (100) previously described without a trip step, compared to the same club head with a trip step (500) located at various positions on the crown section (400). The "offset" referred to in the legend of FIG. 20 is the trip step offset (514) seen in FIG. 15. Thus, experiments were performed and data was gathered for each club head variation at thirteen different orientations from 0 degrees to 120 degrees, in 10 degree increments. The orientations and associated wind direction have been previously touched on and will not be revisited here.

The graph of FIG. 20 clearly illustrates that the lowest normalized aerodynamic drag was achieved when the trip step (500) was located with a two inch trip step offset (514). In fact, the zero degree orientation was the only position in which the normalized aerodynamic drag of the two inch trip step offset (514) was not the lowest of all six variations. The two inch trip step offset (514) is unique in that all the other trip step (500) locations actually produced increased normalized aerodynamic drag at over 80 percent of the orientations when compared to the non-trip step club head.

Interestingly, the final entry in the graph legend of FIG. 20 is "Trip Step @ 2.0 in. Offset C&S" and the line representing this variation produced the second worst normalized aerodynamic drag force numbers. In this variation the "C&S" language refers to "crown" and "sole." Thus, the two inch trip step offset (514) that greatly reduced the normalized aerodynamic drag force when applied to the crown section (400) actually significantly increased the normalized aerodynamic drag force when the trip step (500) was also applied to the sole section (300) of the club head.

In this embodiment the present golf club head (100) has uniquely identified the window of opportunity to apply a trip step (500) and obtain reduced aerodynamic drag force. The trip step (500) must be located behind the crown apex (410). Further, specific locations, shapes, and edge profiles provide preferred aerodynamic results. One embodiment of the golf club head (100) provides a golf club head (100) having a face-on normalized aerodynamic drag force of less than 1.0 lbf when exposed to a 90 mph wind parallel to the ground plane (GP) when the aerodynamic golf club head (100) is positioned in a design orientation and the wind is oriented at the front (112) of the aerodynamic golf club head (100). In a further embodiment the normalized. aerodynamic drag force is less than 1.0 lbf throughout the orientations from 0 degrees up to 110 degrees. In yet another embodiment the normalized aerodynamic drag force is 0.85 lbf or less throughout the orientation of 10 degrees up to 90 degrees. Still further, the two inch trip step offset (514) of FIG. 20 reduced the normalized aerodynamic drag force on average approximately fifteen percent over the club without a trip step throughout the orientation range of 30 degrees up to 90 degrees; conversely, every other trip step (500) location increased the normalized aerodynamic drag force throughout this orientation range.

Figure 21:
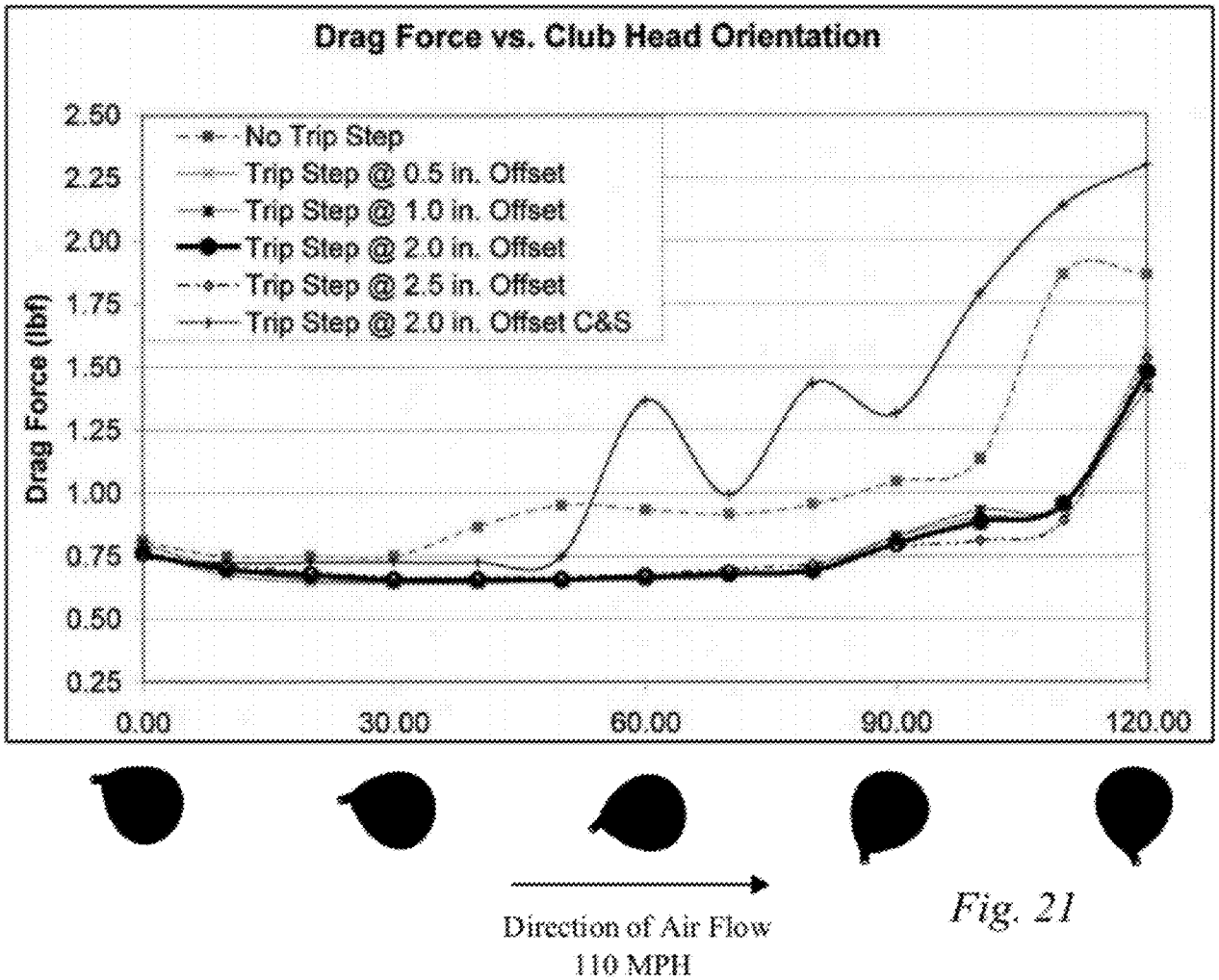
FIG. 21 shows a graph of normalized aerodynamic drag force versus club head orientation for six different configurations at 110 miles per hour.

At a higher wind speed of 110 mph, seen in FIG. 21, all of the crown only trip step (500) embodiments reduced the normalized aerodynamic drag force compared to the non-trip step club. At the higher wind speed the reduction in normalized aerodynamic drag force is even more significant than at the 90 mph wind speed throughout a majority of the orientations. However, the large variations in the normalized aerodynamic drag force associated with various trip step (500) locations is greatly reduced. Since most golfers swing their fairway woods and hybrid type clubs at 80-90 percent of their driver swing speed, FIG. 20 illustrates that the present golf club head (100) is particularly effective at reducing aerodynamic drag force at lower wind speeds making it ideal for fairway woods and hybrid type golf clubs, as well as drivers. Thus, the trip step (500) may be beneficially incorporated in golf club heads of all sizes.

The trip step thickness (540), seen in FIG. 15, is preferably less than 1/16 inch, but may be as much as 1/8 inch. In one particular embodiment the trip step (500) is positioned such that the greatest elevation of the trip step (500) above the ground plane (GP) is less than the apex height (AH), thus the trip step (500) is not visible from a front on face elevation view. The trip step (500) forces the air passing over the aerodynamic club head (100) from laminar flow to turbulent flow just before the natural separation point. This selectively engineered transition from laminar to turbulent flow over the crown section (400) slightly increases the skin friction, but causes less drag than if the air were to detach from the crown section (400) at the natural separation point.

In yet another embodiment, the lineal length of the trip step (500) is greater than seventy-five percent of the heel-to-toe dimension (HT). This length of trip step (500) causes the laminar to turbulent transition over enough of the crown section (400) to achieve the desired reduction in aerodynamic drag force. Further, in another embodiment, the trip step (500) is continuous and uninterrupted. An even further embodiment with a bulbous crown section (400) incorporates a trip step (500) in which the lineal length of the trip step (500) is greater than the heel-to-toe dimension (HT). However, even in this embodiment the trip step (500) is limited to the crown section (400).

Figure 26:
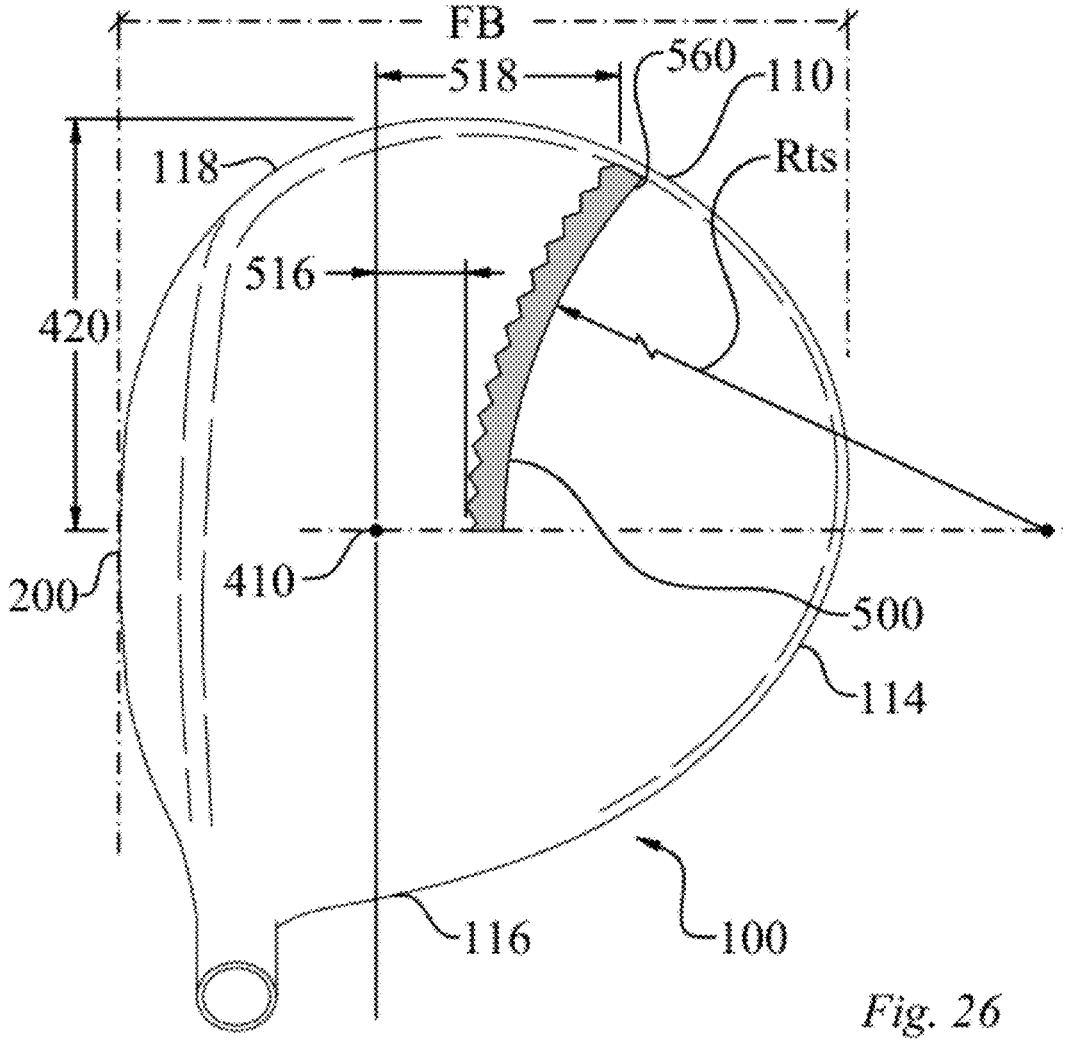
FIG. 26 shows a top plan view of an aerodynamic golf club head having a trip step, not to scale.
Figure 26A:
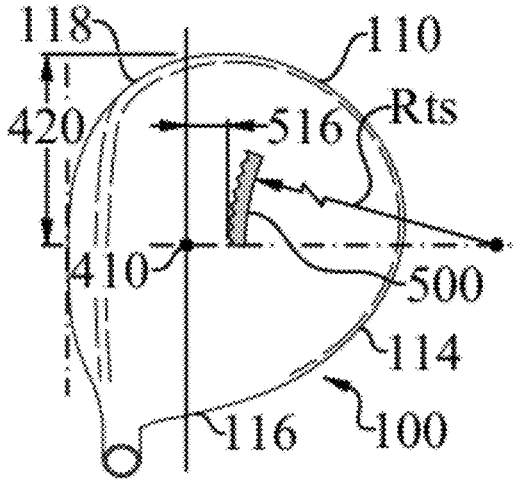
FIG. 26*a* shows a top plan view of an aerodynamic golf club head having a trip step, not to scale.
Figure 26B:
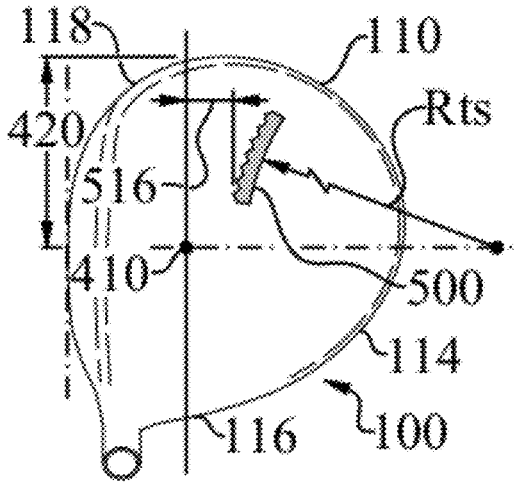
FIG. 26*b* shows a top plan view of an aerodynamic golf club head having a trip step, not to scale.
Figure 26C:
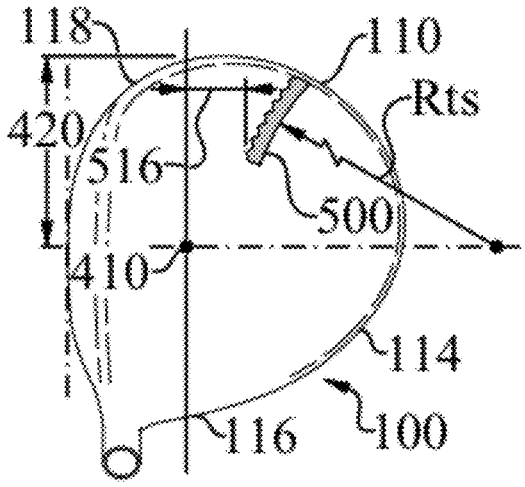
FIG. 26*c* shows a top plan view of an aerodynamic golf club head having a trip step, not to scale.
Figure 27:
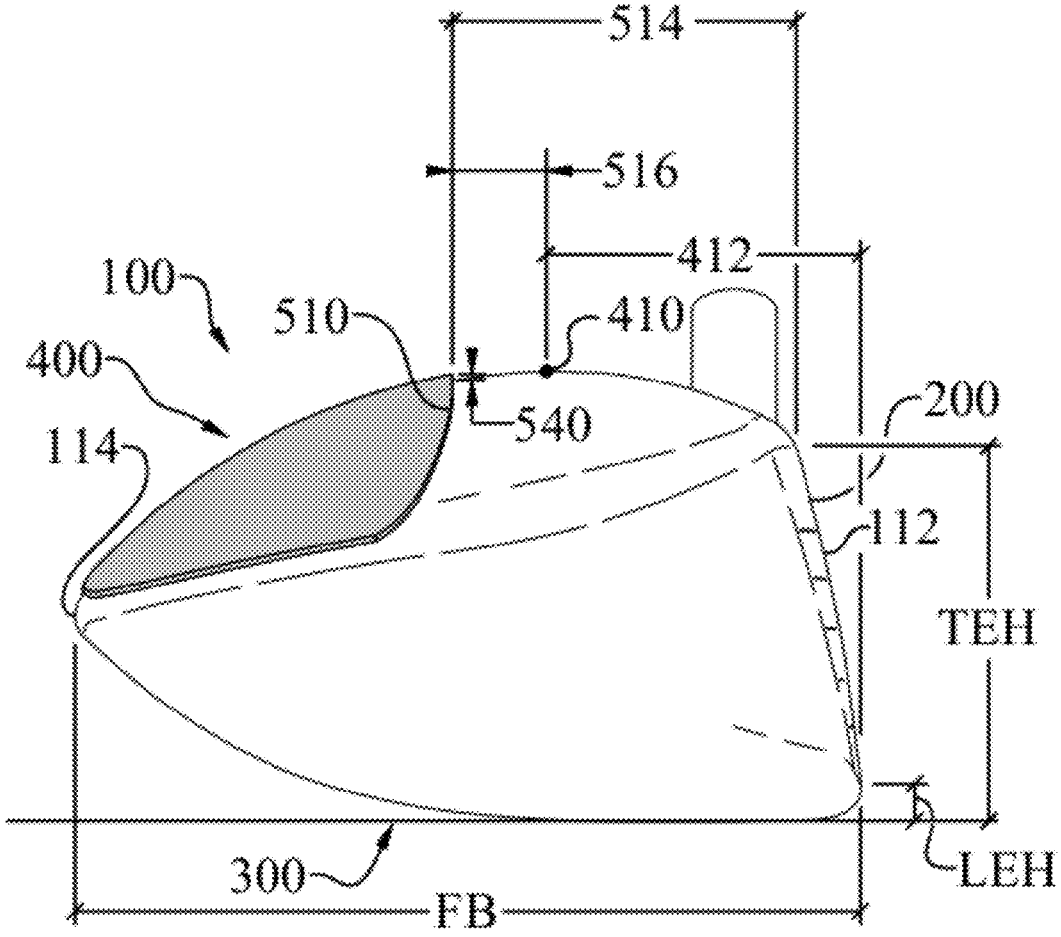
FIG. 27 shows a toe side elevation view of an aerodynamic golf club head, not to scale.
Figure 28:
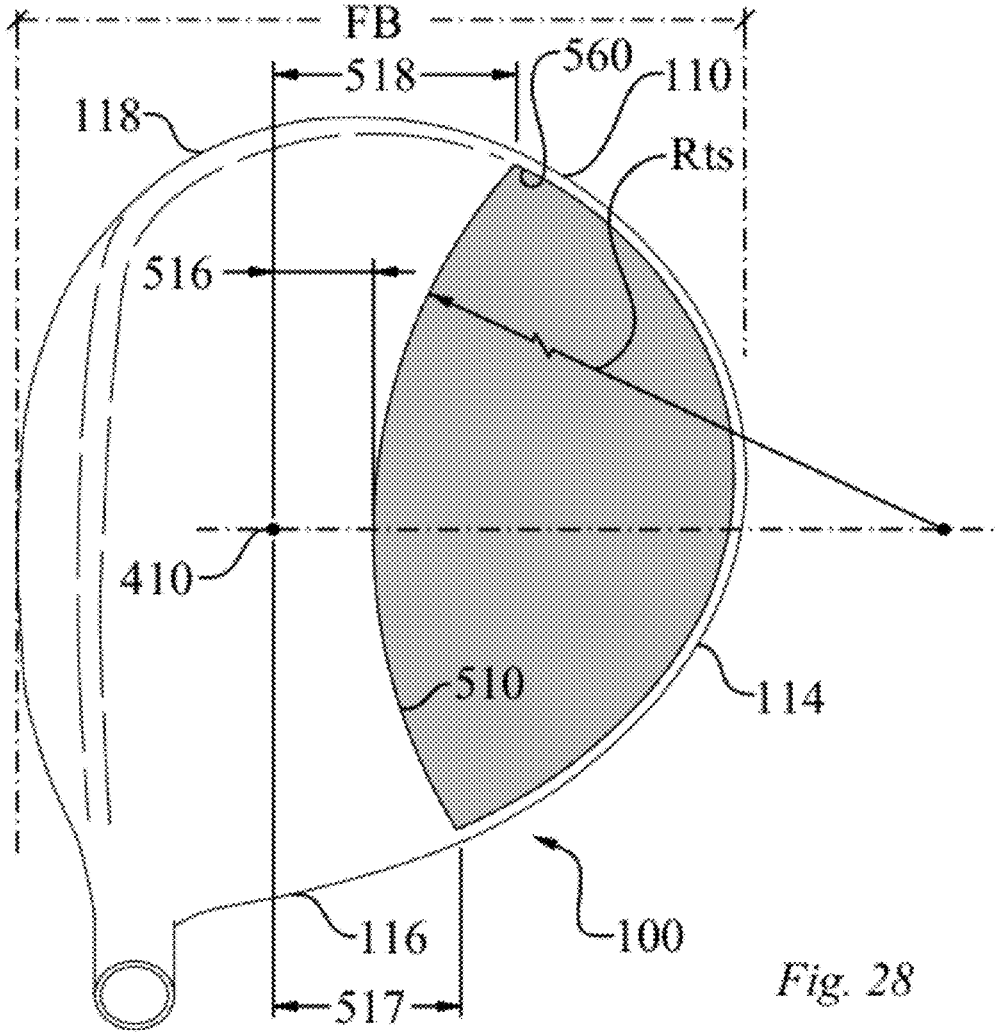
FIG. 28 shows a top plan view of an aerodynamic golf club head having a trip step, not to scale.

While the trip step (500) may extend across a significant portion of the surface of the golf club head (100), it need only extend across a majority of the toe (118) portion of the crown section (400) to obtain the desired reduction in aerodynamic drag force. For example, the trip step (500) of FIG. 26 extends across virtually all of the toe (118) portion of the crown section (400); where the toe (118) portion is defined b r the portion of the golf club (100) from the center of the face outward to the toe (118) in the direction parallel to the shaft axis. Thus, when viewing the club head (100) of FIG. 26, the trip step (500) need only extend across at least 50 percent of the crown toe projection distance (420), where the crown toe projection distance (420) is defined as the two dimensional distance measured in a direction parallel to the shaft axis (SA) in a plane parallel to the ground plane (GP) from the center of the face (200) to the most distant toe (118) portion of the club head (100). In the embodiment of FIG. 26 it just happens to be that the center of the face is inline with the crown apex (410), however this is not required. Therefore, the embodiments seen in FIGS. 26*a*, 26*b*, and 26*c*, each incorporate trip steps (500) achieve desired reductions in aerodynamic drag force with variations of the trip step (500) that extend across at least 50 percent of the crown toe projection distance (420). Further, in the embodiments incorporating discontinuous trip step features, the overall free space between the trip step features should be less than seventy-five percent of the lineal length of the trip step (500) from the heel end (550) to the toe end (560) where the free space is the distance between adjacent trip step features measured in a direction parallel to the shaft axis; as such spacing achieves the necessary disruption in air flow to keep the air attached to the club head (100) beyond the normal non trip step separation points.

Figure 22:
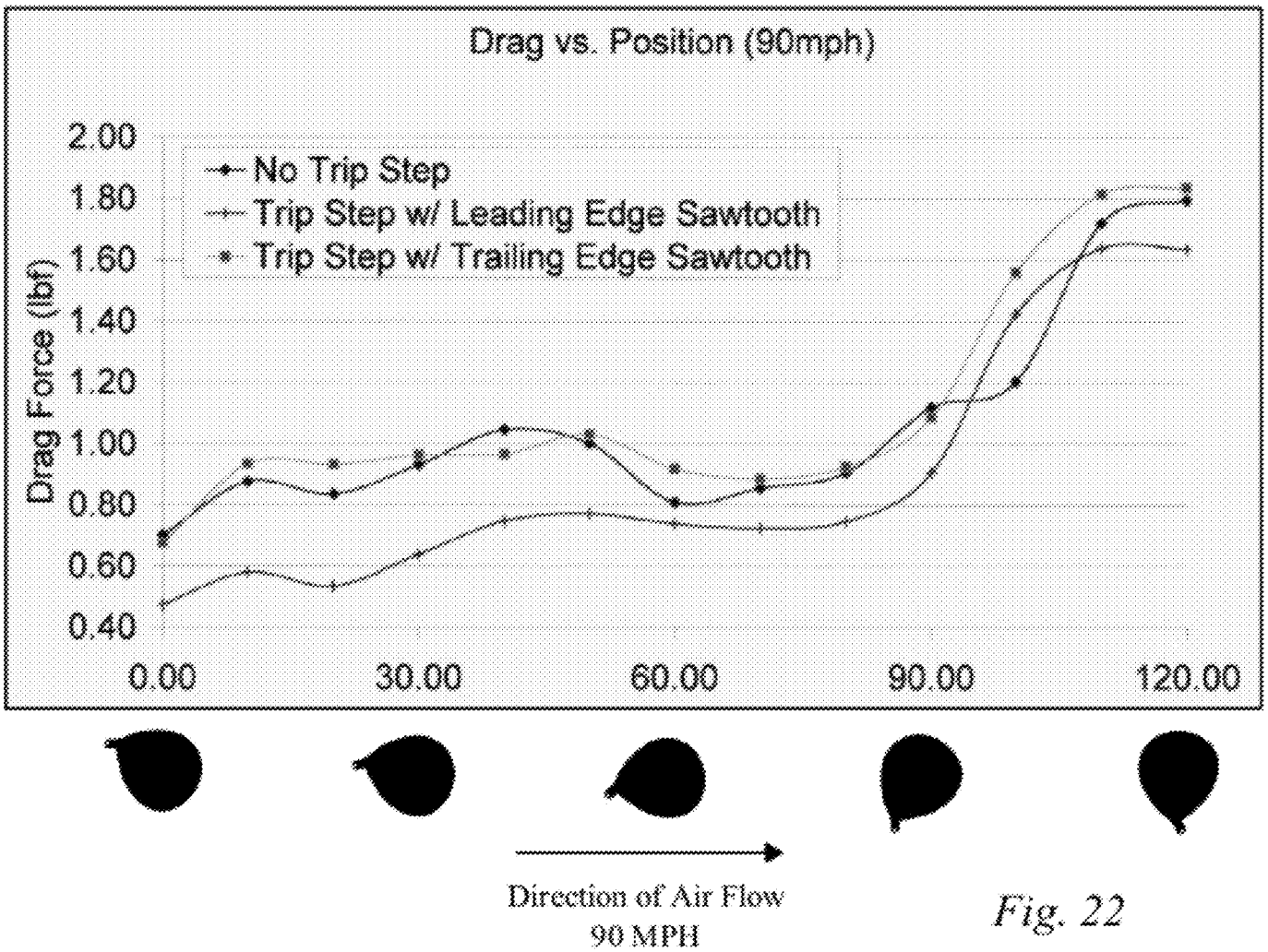
FIG. 22 shows a graph of normalized aerodynamic drag force versus club head orientation for six different configurations at 90 miles per hour.

The leading edge profile (512) of the trip step (500) may be virtually any configuration. Further, the trip step leading edge (510) does not have to be parallel to the trip step trailing edge (520), thus the trip step width (530) may be variable. In one particular embodiment, the leading edge profile (512) includes a sawtooth pattern to further assist in the transition from laminar to turbulent flow, The sawtooth leading edge profile (512), seen in FIGS. 14-19, creates vortices promoting turbulence at the desired engineered locations. The graph of FIG. 22 illustrates that a sawtooth leading edge profile (512) significantly reduces the normalized aerodynamic drag forces, while a similar pattern on the trailing edge profile (522) has minimal impact on the aerodynamic drag forces throughout the orientations. Close comparison of the "No Trip Step" curve and the "Trip Step w/Leading Edge Sawtooth" curve illustrate an approximately 24% reduction in normalized aerodynamic drag force for the positions ranging from zero degrees to ninety degrees.

Further, a trip step width (530) of ¼ inch or less produces a desirable air flow transition. Still further, one embodiment has a trip step width (530) of less than the apex-to-leading edge offset (516). The trip step width (530) does not have to be uniform across the entire length of the trip step (500).

Yet another embodiment has an apex-to-leading edge offset (516), seen best in FIG. 15, of less than fifty percent of the crown apex setback dimension (412) thereby further promoting the transition from laminar to turbulent flow. An even further embodiment obtains desirable reduction in aerodynamic drag force white narrowing the preferred apex-to-leading edge offset (516) range to at least ten percent of the crown apex setback dimension (412). Thus, in this one of many embodiments, the preferred location for the trip step (500) has an apex-to-leading edge offset (516) that is ten to fifty percent of the crown apex setback dimension (412).

While the trip step (500) of FIG. 14 is a single straight trip step (500) with the trip step leading edge (510) parallel to a vertical plane through the shaft axis (SA); the trip step (500) may include several distinct sections, which need not be continuous. For example, the trip step (500) of FIG. 17 is a multi-sectional trip step (570) having at least a heel oriented trip step section (575) and a toe oriented trip step section (580). In this embodiment, the forward most point of the multi-sectional trip step (570) is located behind the crown apex (410) and each section (575, 580) angles back from this forward most point. The heel oriented trip step section (575) diverges from a vertical plane passing through the shaft axis (SA) at a heel section angle (576), and likewise the toe oriented trip step section (580) diverges from a vertical plane passing through the shaft axis at a toe section angle (581). The measurement of these angles (576, 581) can be thought of as the projection of the trip step (500) directed vertically downward onto the ground plane (GP) with the angle then measured along the ground plane (GP) from the vertical plane passing through the shaft axis (SA). One particular embodiment reduces aerodynamic drag force with a design in which the heel oriented trip step section (575) forms a heel section angle (576) of at least five degrees, and the toe oriented trip step section (580) forms a toe section angle (581) of at least live degrees.

The introduction of the multi-sectional trip step (570) affords numerous embodiments of the trip step (500). One particular embodiment simply incorporates a design in which aerodynamic drag force is reduced by incorporating a trip step (500) that has an apex-to-heel LE offset (517) that is greater than the apex-to-leading edge offset (516), and an apex-to-toe LE offset (518) that is greater than the apex-to-leading edge offset (516), which is true of the embodiment seen in FIG. 17. In yet another embodiment, the relationships just described are taken even further, while obtaining a reduction in aerodynamic drag force. In fact, in this embodiment the apex-to-heel LE offset (517) is at least fifty percent greater than the apex-to-leading edge offset (516), and the apex-to-toe LE offset (518) is at least fifty percent greater than the apex-to-leading edge offset (516)

Figure 16:
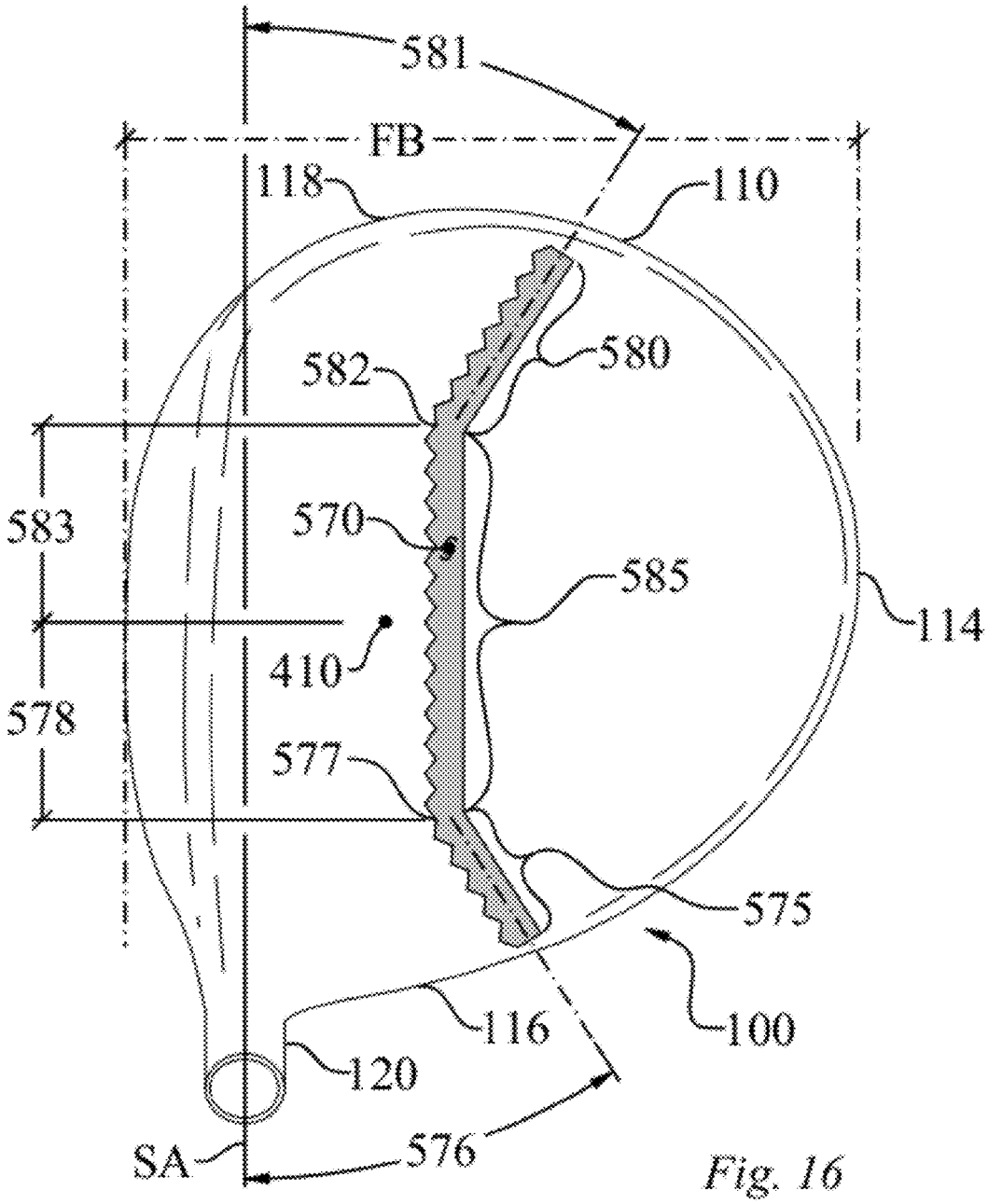
FIG. 16 shows a top plan view of an aerodynamic golf club head having a trip step, not to scale.

Another embodiment of the multi-sectional trip step (570) variation incorporates a face oriented trip step section (585) that is parallel to the vertical plane passing through the shaft axis (SA), as seen in FIG. 16. Thus, this embodiment incorporates a section (585) that is essentially parallel to the face (200), and a section that is not. Such embodiments capitalize on the fact that during a golf swing air does not merely pass over the crown section (400) front the face (200) to the back (114) in a straight manner. In fact, a large portion of the swing is occupied with the golf club head (100) slicing through the air being led by the hosel (120), or the heel (116) side of the club. That said, reducing the face-on aerodynamic drag force, also referred to as the "Air Flow—90°" orientation of FIG. 11, plays a significant role in reducing the aerodynamic drag forces that prevent a golfer from obtaining a higher swing speed. One particular embodiment takes advantage of this discovery by ensuring that the lineal length of the face oriented trip step section (585) is greater than fifty percent of the heel-to-toe dimension (HT).

Yet another embodiment, seen in FIG. 16, incorporates a heel oriented trip step section (575), a toe oriented trip step section (580), and a face oriented trip step section (585). This embodiment has a heel trip step transition point (577) delineating the heel oriented trip step section (575) from the face oriented trip step section (585). Likewise, a toe trip step transition point (582) delineates the toe oriented trip step section (580) from the face oriented trip step section (585). The location of these transition points (577, 582) are identified via a heel transition point offset (578) and a toe transition point offset (583), both seen in FIG. 16. These are distances measured from the crown apex (410) to the locations of the transition points (577, 582) in a direction parallel to a vertical plane passing through the shaft axis (SA). In this particular embodiment it is preferred to have the heel transition point offset (578) greater than the apex-to-heel leading edge offset (517) seen in FIG. 17. Similarly, in this embodiment it is preferred to have the toe transition point offset (583) greater than the toe-to-heel leading edge offset (518) seen in FIG. 17. This unique relationship recognizes the importance of reducing the face-on aerodynamic drag force, also referred to as the "Air Flow —90° " orientation of FIG. 11, while not ignoring the desire to reduce the aerodynamic drag force in other orientations.

Figure 18:
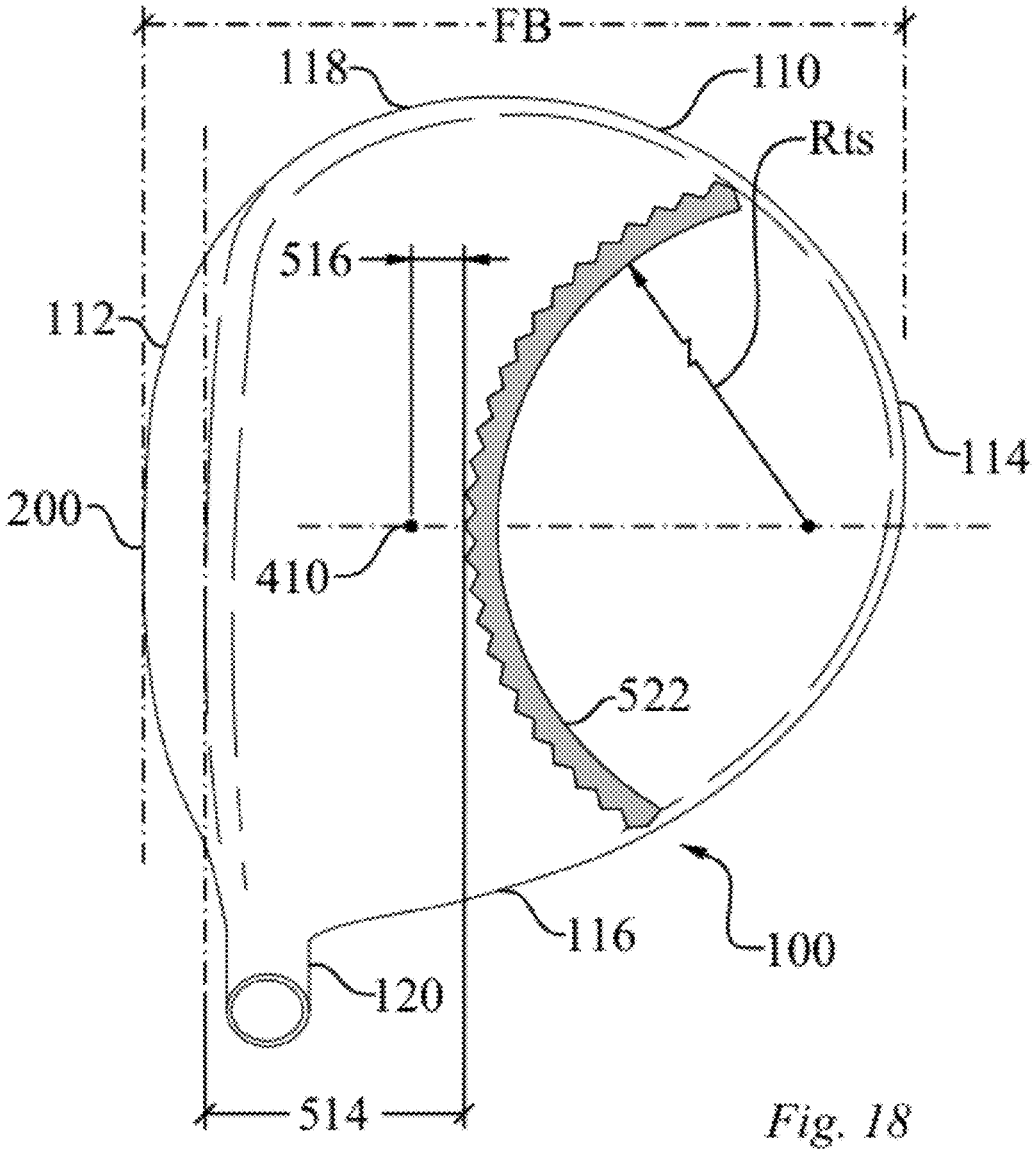
FIG. 18 shows a top plan view of an aerodynamic golf club head having a trip step, not to scale.

Another embodiment directed to the achieving a preferential balance of reducing the aerodynamic drag force in multiple orientations incorporates a curved trip step (500), as seen in FIGS. 18 and 19. The curve of the curved trip step (500) is defined by a vertical projection of the curved trip step (500) onto the ground plane (GP). Then, this translated projection of the outline of the curved trip step (500), or more precisely the trip step leading edge (510), may he identified as having at least one trip step radius of curvature (Rts). In one embodiment, preferred reduction in the aerodynamic drag force is found when the center of the trip step radius of curvature (Rts) is behind the crown apex (410) and the trip step radius of curvature (Rts) is less than twice the apex-to-front radius of curvature (Ra-f), seen in FIG. 9. Further, another embodiment having the trip step radius of curvature (Rts) between 0.5 and 1.5 times the apex-to-front radius of curvature (Ra-f) provides a reduction in the aerodynamic drag force. Further, yet another embodiment incorporates a trip step radius of curvature (Rts) that is less than the bulge of the face (200). An even further embodiment incorporates a trip step radius of curvature (Rts) that is less than the roll of the face (200), One particular embodiment incorporates a trip step radius of curvature (Rts) that is less than twice the apex-to-front radius of curvature (Ra-f), seen in FIG. 9, white having a trip step radius of curvature (Rts) that is less than both the bulge and the roll of the face (200). These newly developed trip step radius of curvature (Rts) ranges tend to result in a trip step (500) curvature that mimics the natural curvature of the air flow separation on the crown section (400) of a golf club head (100), thereby further reducing the aerodynamic drag force.

Yet another embodiment places the trip step (500) at, or slightly in front of, the natural location of air flow separation on the crown section (400) of the club head (100) without the trip step (500). Thus, a club head (100) designed for higher swing speed golfers, such as professional golfers having swing speeds in excess of 110 mph, would have smaller apex-to-leading edge offset (516) than that of a golf club head (100) designed for tower swing speed golfers, such as average golfers with swing speeds of less than 100 mph. This is because air flow passing over the club head (100) at 110 mph naturally wants to separate from the crown section (400) closer to the face (200) of the club head (100). Similarly, air flow passing over the club head (100) at 90 mph tends to stay attached to the crown section (400) much longer and naturally separates from the crown section (400) much further from the face (200) of the golf club (100) than separation naturally occurs at higher air flow velocities.

Therefore, in yet another embodiment, the club head (100) is available in at least two versions; namely one version for high swing speed golfers and one version for lower swing speed golfers. Thus, the "player's club" high swing speed version would have a smaller apex-to-leading edge offset (516) than the more "game improvement club" lower swing speed version. In fact, this may be taken even further in the extremes for extremely fast swing speeds such as those that compete in long drive competitions with swing speeds in excess of 130 mph and, at the other end of the spectrum, for extremely slow swing speeds, less than 85 mph, typically associated with senior's golf clubs and women's golf clubs. Therefore, an entire family of clubs may exist with a long drive version of the club head (100) having a trip step (500) slightly behind the crown apex (410), a player's club version of the club head (100) having a trip step (500) slightly behind the that of the long drive version, a game improvement version of the club head. (100) having a trip step (500) slightly behind that of the player's club version, a super game improvement version of the club head (100) having a trip step (500) slightly behind that of the game improvement version, a senior's version of the club head (100) having a trip step (500) slightly behind that of the super game improvement version, and a women's version of the club head (100) having a trip step (500) slightly behind that of the senior's version, or some combination thereof.

In other words, the apex-to-leading edge offset (516) would be the greatest for club heads (100) designed for slow swing speed golfers and it would approach zero for extremely fast swing speed golfers. In one particular embodiment the apex-to-leading edge offset (516) increases by at least twenty five percent for each 10 mph decrease in design swing speed. Therefore, in one customizable embodiment the trip step (500) is adjustable, or repositionable, so that the location can be adjusted toward, or away from, the crown apex (410) to suit a particular player's swing speed. Similarly, in another embodiment the trip step (500) is adjustable in a heel-to-toe direction, Such adjustments may be made in the process of fitting a golfer for a preferred golf club head (100).

Wind tunnel testing, such as a paint streak test, can be performed to visually illustrate the natural air flow separation pattern on the crown of a particular golf club head design. Then, a curved trip step (500) may be applied to a portion of the crown section (400) at the natural air flow separation curve, or slightly forward of the natural air flow separation curve in a direction toward the face (200). Thus, in this embodiment, seen in FIG. 19, a curved trip step (500) extends over a portion of the crown section (400) from a location behind the crown apex (410) and extending toward the toe (118). In this embodiment, the curved trip step (500) curves from a forward most point behind the crown apex (410) to a most rearward point at the trip step toe end (560). In one particular embodiment, preferred aerodynamic performance is anticipated when the apex-to-toe LE offset (518) is greater than the apex-to-leading edge offset (516). Even further reduction in aerodynamic drag force is achieved when the apex-to-toe LE offset (518) is at least fifty percent greater than the apex-to-leading edge offset (516).

The curved trip step (500) does not need to be one continuous smooth curve. In fact, the curved trip step (500) may be a compound curve. Further, as previously mentioned, the curved trip step (500) is not required to extend toward the heel (116) of the golf club because the disruption in the air flow pattern caused by the hosel (120) results in turbulent air flow near the heel (116), and thus it is unlikely a reduction in aerodynamic drag force wilt be achieved by extending the curved trip step (500) all the way to the heel (116). However, the aesthetically pleasing embodiment of FIG. 19 incorporates a relatively symmetric curved trip step (500) so that it is not distracting to the golfer. Thus, in this one embodiment the apex-to-heel LE offset (517) is greater than the apex-to-leading edge offset (516), and the apex-to-toe LE offset (518) is greater than the apex-to-leading edge offset (516).

Figure 23:
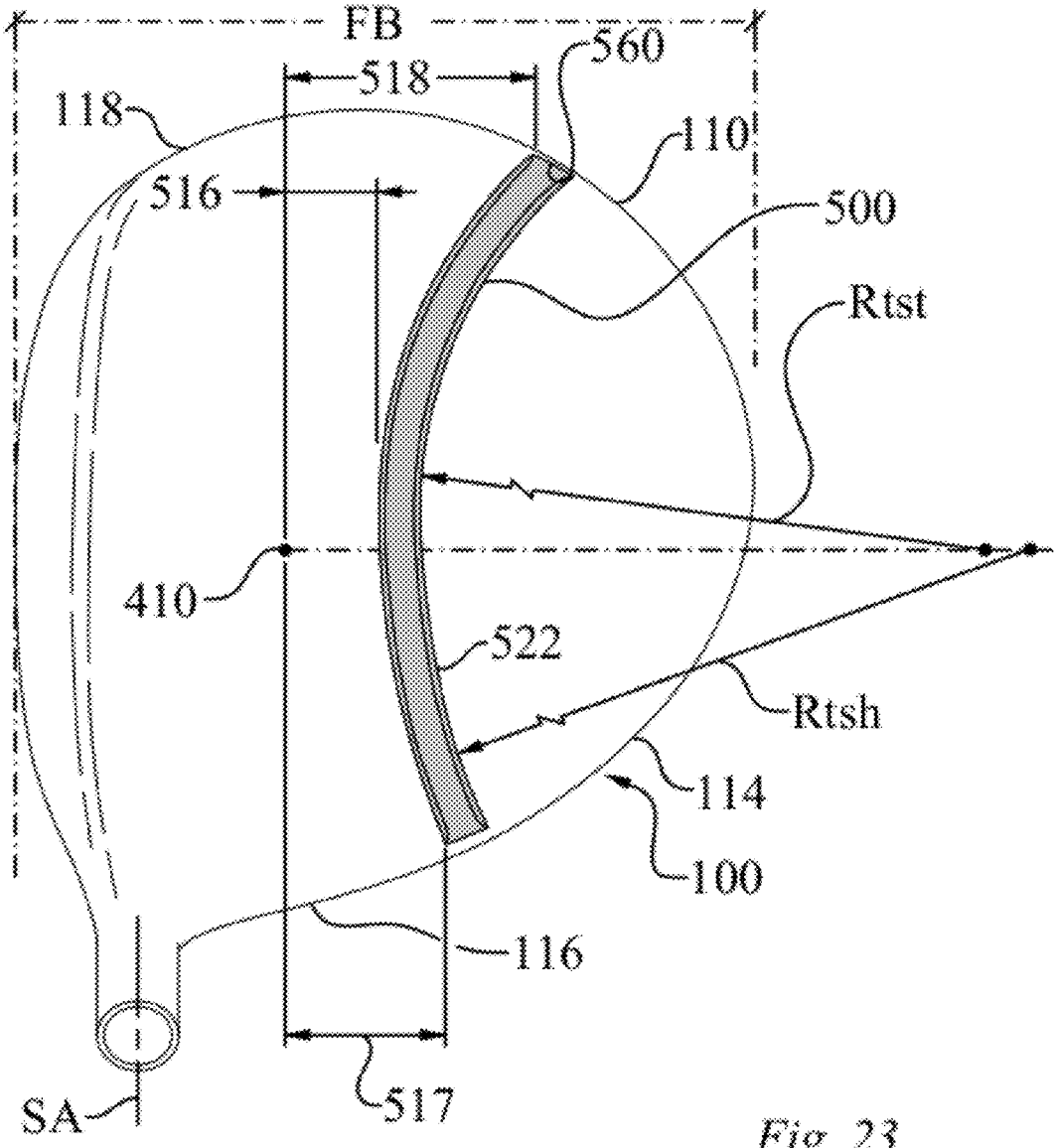
FIG. 23 shows a top plan view of an aerodynamic golf club head having a trip step, not to scale.

Further, an additional embodiment, seen in FIG. 23 recognizes this hosel (120) created turbulence and incorporates a trip step (500) having at least two trip step radii; namely a toe radius of curvature (Rtst), on the portion of the trip step (500) nearest the toe (118) side of the club head (100), and a heel radius of curvature (Rtsh), on the portion of the trip step (500) nearest the heel (116) side of the club head (100). This embodiment has a heel radius of curvature (Rtsh) is greater than the toe radius of curvature (Rtst), thereby taking advantage of the fact that the air flow separates from the club head (100) on the heel (116) side significantly more toward the face than the natural separation points on the toe (118) side of the club head (100). Therefore, one of the many embodiments herein incorporates a trip step (500) having a heel radius of curvature (Rtsh) that is at least ten percent greater than the toe radius of curvature (Rtst). An even further embodiment incorporates a trip step (500) having a heel radius of curvature (Rtsh) that is at least twenty-five percent greater than the toe radius of curvature (Rtst).

One further embodiment recognizes that a preferential reduction in aerodynamic drag force is obtained when at least a portion of the trip step (500) has a trip step radius of curvature (Rts) that is less than the apex-to-front radius of curvature (Ra-f). An even further embodiment incorporates a trip step (500) in which at least a portion of the trip step (500) has a trip step radius of curvature (Rts) that is less than four inches. Likewise, recognizing that the curvature of the crown's rear natural airflow separation line is generally tighter and better defined on the toe side (118) of the club head (100), an even further embodiment incorporates a trip step (500) in which at least a portion of the trip step (500) has a toe radius of curvature (Rtst) that is less than four inches. Such a small, or tight, trip step radius of curvature (Rts) ensures that at least a portion of the trip step (500) tends to mimic the shape of natural airflow separation from the rear of the crown section (400).

Figure 24:
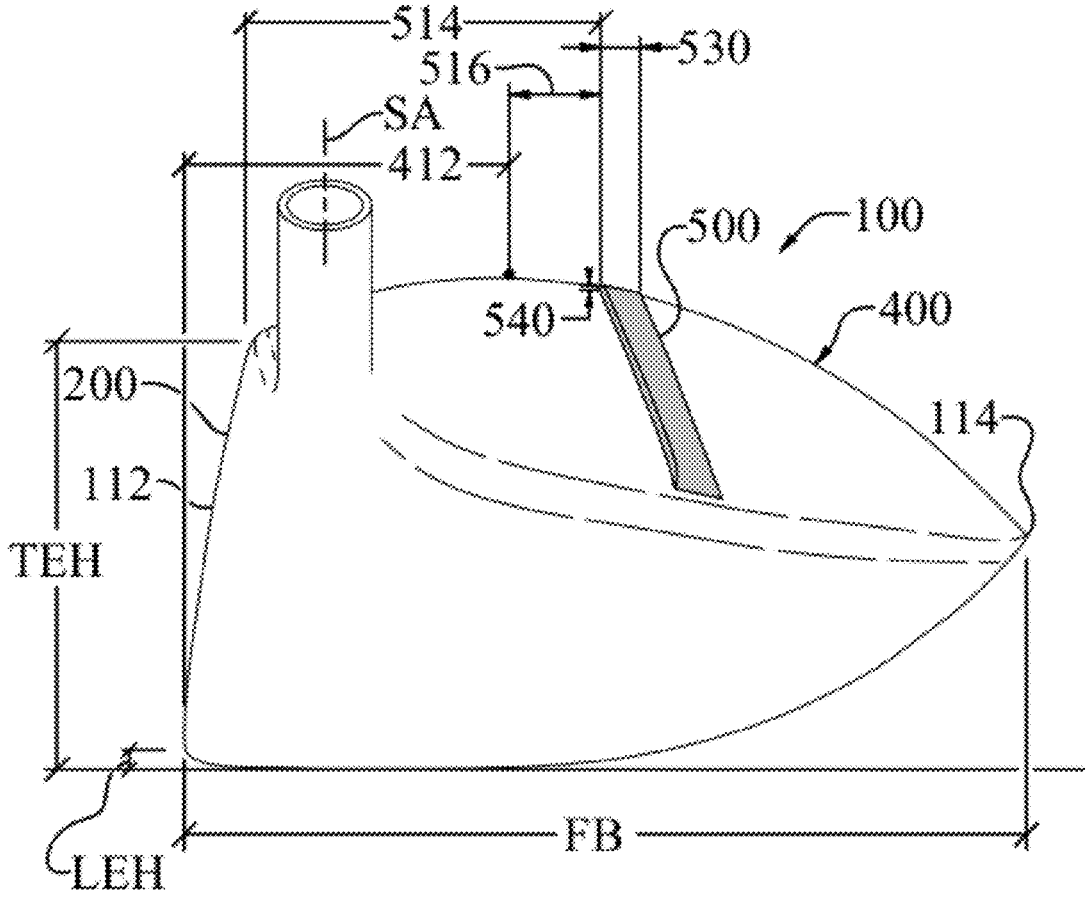
FIG. 24 shows a heel side elevation view of an aerodynamic golf club head, not to scale.
Figure 25:
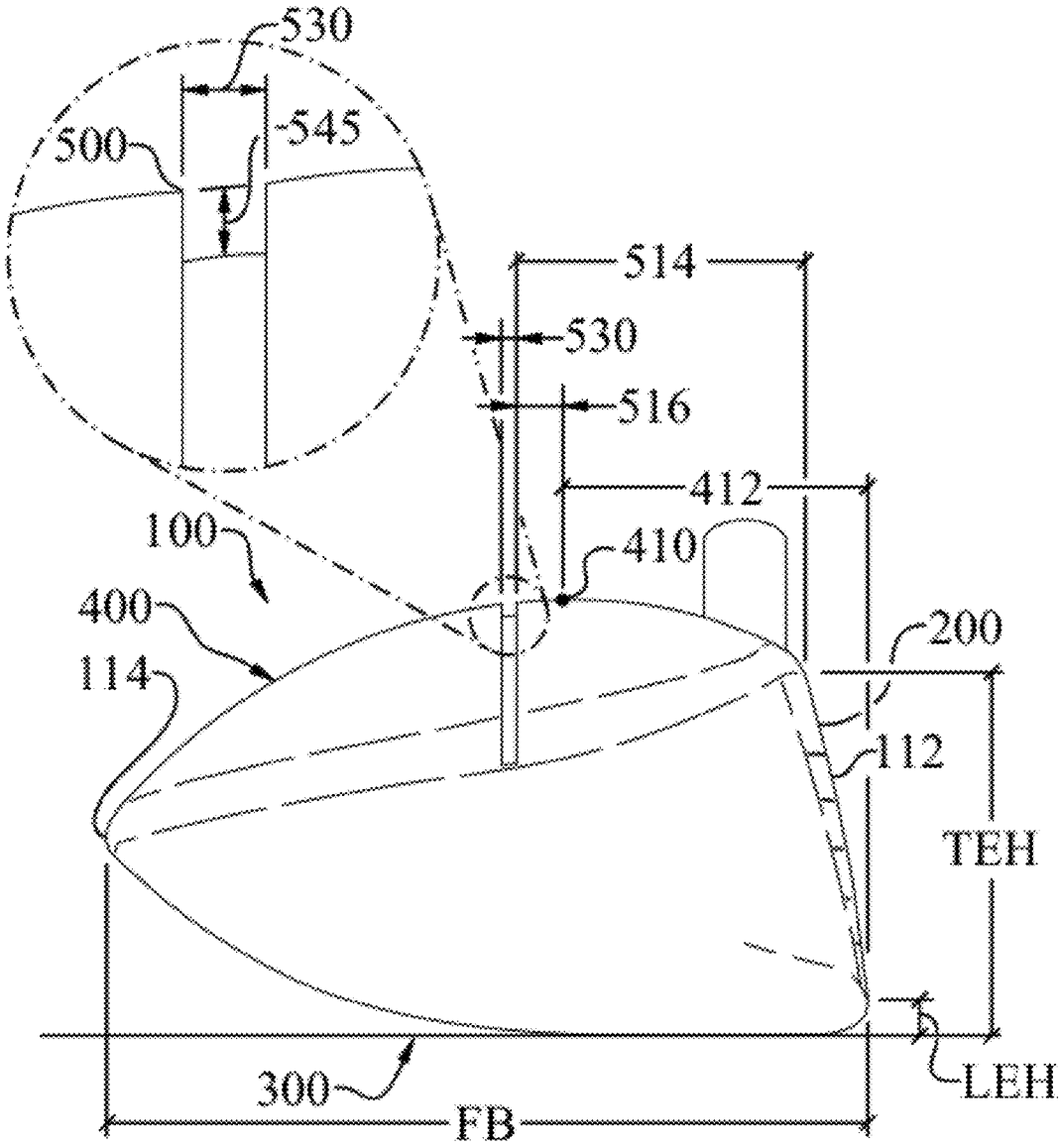
FIG. 25 shows a toe side elevation view of an aerodynamic golf club head, not to scale.

As previously touched upon, the trip step (500) may be in the form of a projection from the normal curvature of the club head (100), as seen in FIG. 24, or may be in the form of an indentation in the normal curvature of the club head (100), as seen in FIG. 25. Thus, in these indentation embodiments the trip step (500) has a trip step depth (545). All of the discussion herein with reference to the trip step (500), and specifically the trip step (500) shape and location, applies equally to an indentation, or negative change in the normal curvature of the club head (100). Thus, just as a positive projecting trip step (500) creates turbulence prior to the natural point of air separation from the club head (100) thereby keeping the air flow attached to the club head (100) longer and reducing the aerodynamic drag force, a negative indentation trip step (500) having a trip step depth (545) does the same and affords similar benefits. While the trip step (500) location and shape, as previously explained, are the leading factors in the reduction of aerodynamic drag, in yet another embodiment the trip step depth (545) is preferably at least five percent of the difference between the apex height (AH) and the top edge height (TEH), seen in FIG. 9. In a further embodiment a desirable reduction in aerodynamic drag force is found when the trip step width (530) is at least as great as the trip step depth (545). Just as with the positive projecting trip step (500) embodiments, the negative indented trip step (500) of FIG. 25 need not have a defined, or identifiable, trip step trailing edge (520). Thus, the positive trip step plateau of FIG. 27 may alternatively be a negative low lying region.

Further, the trip step (500) need not have a specifically identifiable trip step trailing edge (520), as seen in FIGS. 27, 28, and 30-33. In other words, these embodiments have distinct trip step leading edges (510), while the remainder of the trip step (500) remains of constant thickness (540) or transitions back to the normal curvature of the club head (100) in a smooth transition. The distinct leading edge (510) provides the engineered creation of turbulence that keeps the airflow attached to the club head (100) longer than that of a non trip step club head while having little, if any, negative effect as a result of the lack of a distinct trailing edge (520). Thus, in one such embodiment, seen in FIG. 27, the trip step (500) is essentially a positive plateau on the crown section (400); however, as previously explained, it could also be a negative plateau and achieve similar effect.

Figure 31:
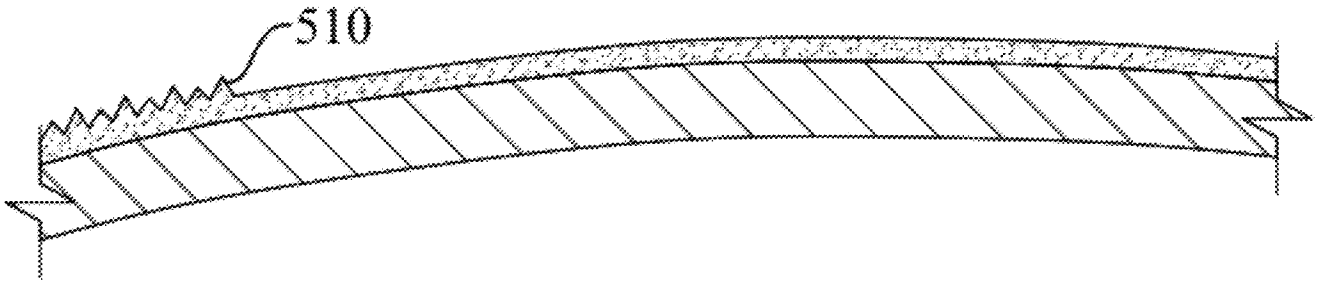
FIG. 31 shows a partial cross-sectional view taken along section line 31-31 of FIG. 30, not to scale.
Figure 32:
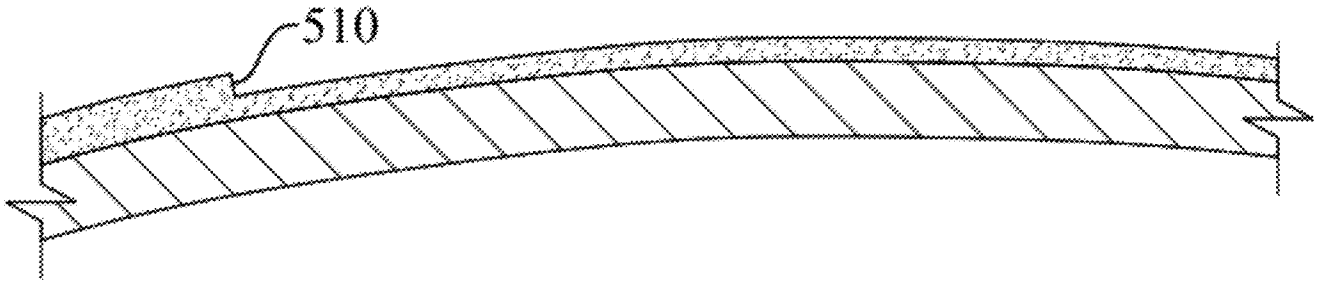
FIG. 32 shows a partial cross-sectional view taken along section line 31-31 of FIG. 30, not to scale.
Figure 33:
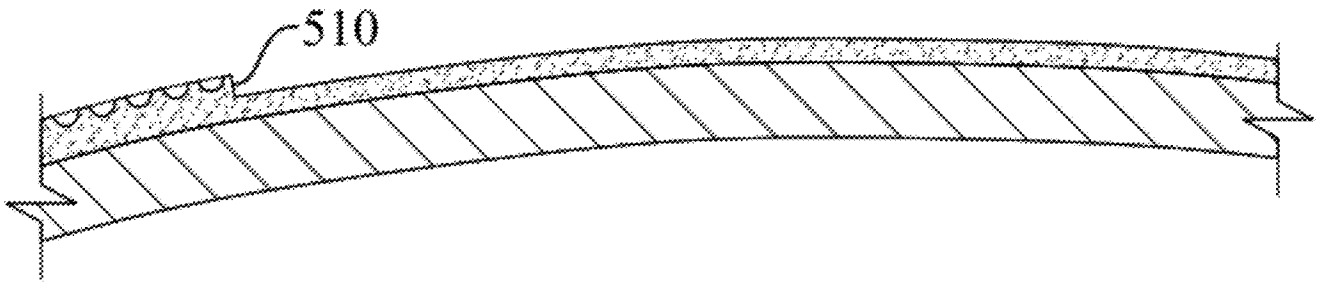
FIG. 33 shows a partial cross-sectional view taken along section line 31-31 of FIG. 30, not to scale.

The trip step (500) may be achieved with any number of construction techniques. One embodiment incorporates an increase in material thickness, or a reduction of material thickness. Alternatively, another embodiment creates the trip step (500) with the addition of an adhesive graphic of the shape and thickness defined herein. Further, an additional embodiment incorporates an increase, or decrease, in the finish thickness of the club head (100), as seen in FIGS. 31-33, as would be experienced with additional layers of paint, or lack thereof. Still. further embodiments incorporate material milling and working processes to create the trip step (500). Such processes may include, but are not limited to, peening and stamping techniques. Yet further embodiments incorporate a change in material finish, such as the use of a matte finish, or any finish having a rougher surface texture than the portion of the club head (100) in front of the trip step (500), i.e. toward the face (200), as seen in FIGS. 31 and 33.

Numerous alterations, modifications, and variations of the preferred embodiments disclosed herein will be apparent to those skilled in the art and they are all anticipated and contemplated to be within the spirit and scope of the instant aerodynamic golf club head. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present aerodynamic golf club head are described herein, it is to be understood that the practice of such additional modifications and variations and the equivalents thereof, are within the spirit and scope of the aerodynamic golf club head as defined in the following claims. The corresponding structures, materials, acts, and equivalents of all means or step plus function elements in the claims below are intended to include any structure, material, or acts for performing the functions in combination with other claimed elements as specifically claimed.

We claim:

1. An aerodynamic golf club head (100) comprising:

a) a hollow body (110) having a face (200), a sole section (300), a crown section (400), a front (112), a back (114), a heel (116), a toe (118), a volume of at least 400 cubic centimeters, and a maximum front-to-back dimension (fb) of at least 4.4 inches, wherein a portion of the crown section (400) between the crown apex (410) and the face (200) has an apex-to-front radius of curvature (ra-f);

b) the face (200) having a top edge (210) and a lower edge (220), wherein a top edge height (teh) is the elevation of the top edge (210) above a ground plane (gp), and a lower edge height (leh) is the elevation of the lower edge (220) above the ground plane (gp);

c) the crown section (400) having a crown apex (410) located an apex height (ah) Above the ground plane (gp), wherein the crown section (400) has a trip step (500) having a portion located between the crown apex (410) and the back (114), and the trip step (500) has;

i) a trip step heel end (550), a trip step toe end (560), and a trip step thickness (540);

ii) a trip step leading edge (510) having a leading edge profile (512), and wherein:

a) the trip step leading edge (510) is located a trip step offset (514) behind the face top edge (210);

b) the trip step leading edge (510) is located behind the crown apex (410) an apex-to-leading edge offset (516);

c) the trip step leading edge (510) at the trip step heel end (550) is located behind the crown apex (410) an apex-to-heel le offset (517);

d) the trip step leading edge (510) at the trip step toe end (560) is located behind the crown apex (410) an apex-to-toe le offset (518);

e) a portion of the trip step leading edge (510) is at an elevation above the ground plane (gp) that is less than a maximum top edge height (teh); and f) the trip step (500) includes at least one curve that has a trip step radius of curvature (rts), and at least a portion of the trip step radius of curvature (rts) is less than twice the apex-to-front radius of curvature (ra-f).

2. The aerodynamic golf club head (100) of claim 1, wherein the portion of the trip step leading edge (510) that is at an elevation above the ground plane (gp) that is less than a maximum top edge height (teh), is located between the crown apex (410) and the toe (118).

3. The aerodynamic golf club head (100) of claim 1, further including a second portion of the trip step leading edge (510) located between the crown apex (410) and the heel (116) that is at an elevation above the ground plane (gp) that is less than a maximum top edge height (teh).

4. The aerodynamic golf club head (100) of claim 1, wherein a portion of the trip step leading edge (510) has a trip step offset (514) that is greater than the maximum top edge height (teh).

5. The aerodynamic golf club head (100) of claim 1, wherein the trip step leading edge (510) has a maximum apex-to-leading edge offset (516) that is at least four times a minimum apex-to-leading edge offset (516).

6. The aerodynamic golf club head (100) of claim 1, wherein at least fifty percent of the trip step leading edge (510) that is at an elevation above the ground plane (gp) that is less than a maximum top edge height (teh), is located between the crown apex (410) and the toe (118).

7. The aerodynamic golf club head (100) of claim 1, wherein the most rearward point of the trip step leading edge (510) is located at the trip step toe end (560), and the crown apex (410) is located between a center of gravity (cg) and the toe (118).

8. The aerodynamic golf club head (100) of claim 1, wherein the club head (100) has a crown toe projection distance (420) measured in a direction parallel to a shaft axis (sa) in a plane parallel to the ground plane (gp) from a center of the face (200) to the most distant toe portion (118) of the club head (100), and the trip step (500) extends across at least fifty percent of the crown toe projection distance (420) at an elevation above the ground plane (gp) that is less than the maximum top edge height (teh).

9. The aerodynamic golf club head (100) of claim 1, wherein the trip step radius of curvature (rts) is at least fifty percent of the apex-to-front radius of curvature (ra-f), and no greater than one hundred and fifty percent of the apex-to-front radius of curvature (ra-f).

10. The aerodynamic golf club head (100) of claim 1, wherein the trip step (500) has at least a toe radius of curvature (rtst) and a heel radius of curvature (rtsh), and a portion of the heel radius of curvature (rtsh) at an elevation above the ground plane (gp) that is less than the maximum top edge height (teh) is greater than a portion of the toe radius of curvature (rtst) at an elevation above the ground plane (gp) that is less than the maximum top edge height (teh).

11. The aerodynamic golf club head (100) of claim 1, wherein the trip step leading edge (510) is separated from a trip step trailing edge (520) by a trip step width (530), wherein the trip step width (530) is less than the apex-to-leading edge offset (516).

12. The aerodynamic golf club head (100) of claim 1, wherein the hollow body (110) has a maximum top edge height (teh) of at least 2 inches and the trip step offset (514) is at least two inches.

13. The aerodynamic golf club head (100) of claim 1, wherein at least a portion of the trip step (500) projects outward from the club head (100) and a point of maximum projection has a trip step thickness (540), wherein the point of maximum projection does not extend above the crown apex (410).

14. The aerodynamic golf club head (100) of claim 1, wherein at least a portion of the trip step (500) projects inward toward an interior of the club head (100) and a point of maximum projection has a trip step depth (545), wherein the trip step depth (545) is at least five percent of the difference between the apex height (AH) and the top edge height (TEH).

15. The aerodynamic golf club head (100) of claim 14, wherein the trip step leading edge (510) is separated from a trip step trailing edge (520) by a trip step width (530), and the trip step width (530) is at least equal to twice the trip step depth (545).

16. The aerodynamic golf club head (100) of claim 1, wherein the crown apex setback dimension (412) is less than a shortest distance between a vertical projection of the center of gravity (cg) on the ground plane (gp) and a second vertical projection of the forward most point on the face (200), and the crown apex (410) is located between a center of gravity (cg) and the toe (118).

17. An aerodynamic golf club head (100) comprising:

a) a hollow body (110) having a face (200), a sole section (300), a crown section (400), a front (112), a back (114), a heel (116), a toe (118), a volume of at least 400 cubic centimeters, and a maximum front-to-back dimension (fb) of at least 4.4 inches, wherein a portion of the crown section (400) between the crown apex (410) and the face (200) has an apex-to-front radius of curvature (ra-f);

b) the face (200) having a top edge (210) and a lower edge (220), wherein a top edge height (teh) is the elevation of the top edge (210) above a ground plane (gp), and a lower edge height (leh) is the elevation of the lower edge (220) above the ground plane (gp), a maximum top edge height (teh) of at least 2 inches;

C) the crown section (400) having a crown apex (410) located an apex height (ah) above the ground plane (gp), wherein the crown section (400) has a trip step (500) having a portion located between the crown apex (410) and the back (114), and the trip step (500) has;

i) a trip step heel end (550), a trip step toe end (560), and a trip step thickness (540);

ii) a trip step leading edge (510) having a leading edge profile (512), and wherein:

a) the trip step leading edge (510) is located a trip step offset (514) behind the face top edge (210) wherein the trip step offset (514) is at least 2 inches;

b) the trip step leading edge (510) is located behind the crown apex (410) an apex-to-leading edge offset (516);

c) the trip step leading edge (510) at the trip step heel end (550) is located behind the crown apex (410) an apex-to-heel le offset (517);

d) the trip step leading edge (510) at the trip step toe end (560) is located behind the crown apex (410) an apex-to-toe le offset (518);

e) a portion of the trip step leading edge (510) is at an elevation above the ground plane (gp) that is less than a maximum top edge height (teh); and f) the trip step (500) includes at least one curve that has a trip step radius of curvature (rts), and at least a portion of the trip step radius of curvature (rts) is less than twice the apex-to-front radius of curvature (ra-f).

18. The aerodynamic golf club head (100) of claim 17, wherein the trip step leading edge (510) has a maximum apex-to-leading edge offset (516) that is at least four times a minimum apex-to-leading edge offset (516).

19. The aerodynamic golf club head (100) of claim 17, wherein the trip step leading edge (510) is separated from a trip step trailing edge (520) by a trip step width (530), and the trip step width (530) is at least equal to twice the trip step depth (545).

* * * * *

UNITED STATES PATENT AND TRADEMARK OFFICE

CERTIFICATE OF CORRECTION

PATENT NO. : 8,777,773 B2
APPLICATION NO. : 13/584479
DATED : July 15, 2014
INVENTOR(S) : Burnett et al.

It is certified that error appears in the above-identified patent and that said Letters Patent is hereby corrected as shown below:

In the Specification:

Column 7 - Line 18
Delete "(112)" and insert --(114)--

Column 9 - Line 13
Delete "(TEE)" and insert --(TEH)--

Column 9 - Line 29
Delete "oven" and insert --even--

Column 9 - Line 49
Delete "to" and insert --toe--

Column 14 - Line 21
Delete "live" and insert --five--

Column 15 - Line 50
Delete "tower" and insert --lower--

Column 16 - Line 58
Delete "wilt" and insert --will--

Signed and Sealed this
Seventh Day of October, 2014

Michelle K. Lee

Michelle K. Lee
*Deputy Director of the United States Patent and Trademark Office*